US009892898B2

(12) United States Patent
Bango et al.

(10) Patent No.: US 9,892,898 B2
(45) Date of Patent: Feb. 13, 2018

(54) METHOD OF IMPROVED PAPER BASED MASS SPECTROMETRY AND NOVEL WICK SUPPORT STRUCTURES

(71) Applicants: Joseph J. Bango, New Haven, CT (US); Michael E. Dziekan, Bethany, CT (US)

(72) Inventors: Joseph J. Bango, New Haven, CT (US); Michael E. Dziekan, Bethany, CT (US)

( * ) Notice: Subject to any disclaimer, the term of this patent is extended or adjusted under 35 U.S.C. 154(b) by 0 days.

(21) Appl. No.: 14/756,980

(22) Filed: Nov. 3, 2015

(65) Prior Publication Data

US 2017/0125228 A1 May 4, 2017

(51) Int. Cl.
*H01J 49/00* (2006.01)
*H01J 49/04* (2006.01)

(52) U.S. Cl.
CPC ..... *H01J 49/0445* (2013.01)

(58) Field of Classification Search
CPC ..... H01J 49/0445
USPC ..... 250/281, 282, 288, 425
See application file for complete search history.

(56) References Cited

U.S. PATENT DOCUMENTS 6,297,499 B1 * 10/2001 Fenn ..... H01J 49/167 250/288
8,704,167 B2 * 4/2014 Cooks ..... C12Q 1/04 250/281
8,816,275 B2 * 8/2014 Ouyang ..... H01J 49/0431 250/288
8,895,918 B2 * 11/2014 Cooks ..... H01J 49/168 250/281
9,224,587 B2 * 12/2015 Krechmer ..... H01J 49/049
2012/0119079 A1 * 5/2012 Ouyang ..... H01J 49/0431 250/282
2014/0048697 A1 * 2/2014 Cooks ..... C12Q 1/04 250/281
2014/0183351 A1 * 7/2014 Cooks ..... H01J 49/168 250/282
2015/0325423 A1 * 11/2015 Ouyang ..... H01J 49/0409 250/282

OTHER PUBLICATIONS

Yang, et al ("Paper spray ionization devices for direct, biomedical analysis using mass spectrometry" Int'l J. Mass Spectrom. 312 (2012) 201-207).*

* cited by examiner

*Primary Examiner* — Michael Maskell

(57) ABSTRACT

The disclosed invention relates to electrospray and more specifically to wick based electrospray of analytes. The disclosed invention provides a means for improved electrospray extraction of analytes using a capillarity based fluid delivery system. The disclosed invention employs a wire screen mesh sandwiching the substrate media, without impeding capillarity of a wetting solvent spray fluid applied to the substrate. A further benefit is that electrical contact can be made to the substrate. Yet another benefit is that the substrate and wire mesh can be further enclosed in a polymer or other insulating sleeve that is flat and very thin, the preferred form factor is very similar to that of a credit card.

8 Claims, 29 Drawing Sheets

Figure I

METHOD OF IMPROVED PAPER BASED MASS SPECTROMETRY AND NOVEL WICK SUPPORT STRUCTURES

BACKGROUND

Field of Invention

The disclosed invention relates to electrospray and more specifically to wick based electrospray of analytes. The disclosed invention provides a means for improved electrospray extraction of analytes using a capillarity based fluid delivery system.

Background Description of Prior Art

Electrospray ionization as discovered by Fenn et al in the early 1980's at Yale University essentially launched the field of proteomics, which permitted the detection and study of fragile organic molecules by mass spectrometry. While working Fenn's lab, we used as an electrospray source a needle with a conductive solvent-analyte fluid fed by a hydrostatic source, in this case, a syringe pump. Control of the needle flow rate and applied voltage were important variables to control to produce a good spray and thus transition into a plurality of droplets, which contained the analyte of interest. A counter-current drying gas helped aid the evaporation of the solvent species leaving intact analyte ions in the gas phase with multiple charges. These gas phase ions were then allowed to be introduced into the partial pressure region of the mass spectrometer. During the use of small gauge needles, we found that clogging could be an issue if any particulate contamination were present. In the late 1980's, John Fenn mentioned to the present inventor his having re-read Michael Faraday's "Chemical History of the Candle". In this treatise, Faraday observed that the capillarity of the wick material regulated the flow of paraffin to the flame. No flame, no capillary flow. The system then, was in perfect balance for fluid flow. In addition, the presence of contaminants that would otherwise cause clogging in a hydrostatically fed electrospray needle would be of no consequence. Accordingly, John tried using various wick materials as electrospray sources, with great success as with many of his innovative and deceptively simple ideas. This work resulted in his "wick" U.S. Pat. No. 6,297,499 issued on Oct. 2, 2001. While the claims in this patent concerned attaching a wick source in direct contact and continuous contact to the analyte-solvent fluid, using the wick to create a self-balancing electrospray introduced into a mass spectrometer, John did offer several other forms of wick sprays not covered by his claims. For example, description is made using any wettable wick structure, whether bundles of small fibers, made of glass, graphite, paper, cotton, and linen have been used with great success. In one adaptation mentioned, flat strips of cloth or paper work just as well as electrospray sources. It was as a result of these wicking properties that the inventor and John Fenn applied the concept to space propulsion (*Capillarity Driven Flow of Propellant Liquids in Colloidal Satellite Thrusters*), NASA Contract NAS3-02048 in 2001, and Air Force Contract F045-005-0131 in 2005. John offered publicly the use of wicks alone as electrospray sources for many other applications, including air sampling and fluid nebulization. One of the more interesting ideas of John was what is now referred to as "paper spray mass spectrometry". In such a use, a wettable piece of media, preferably paper, is cut to a sharp point and held in place using a clip such as an alligator clip. Spray fluid, sufficiently conductive to bring about the production of a Taylor Cone and thus an electrospray, is dripped onto the paper. A field is applied between the paper using the aforementioned clip as a pole and with the paper and clip proper combination having a field with respect to a counter pole or electrode. The potential difference between the pole and electrodes is adjusted to allow the formation of the previously described Taylor Cone which results in the production of the now well know electrospray phenomenon. Many investigators have utilized paper spray and similar stand-alone wicking spray mechanisms, but the technology has not been suited toward large-scale drug and proteomic and other use because of several severe limitations. For one, the attachment of the paper or other suitable media to a clip is slow and labor intensive. Care must be taken to preclude contamination between paper samples. Alignment of the paper with respect to axis and distance from the counter electrode is essential. The applied field must be carefully adjusted as does the fluid feed drip rate necessary to wet the paper or other suitable media continuously to provide a steady and/or stable electrospray. Until the present disclosed invention, these limitations have essentially relegated paper spray to the research lab and not the clinical laboratory. The disclosed invention overcomes the need for precise paper alignment, contamination, and offers fully automatic control of fluid and voltage variables all the while permitting use by lay personnel.

In other prior art, Purdue University has been actively investigating paper spray applications after Fenn shared ideas with investigators of that institution over the years from the late 1990's through 2010, and especially during his $90^{th}$ birthday celebration at Virginia Commonwealth University. In a recent Purdue patent embodiment, a paper source is contained in a polymer cassette. The cassette has a sampling orifice and a contact electrode. In contrast to the disclosed invention, the Purdue device is bulkier, more expensive to produce, and slower to analyze a given sample than the disclosed invention. In addition, the Purdue device cannot provide continuous electrosprays necessary for detailed protein and enzyme studies, being limited to transitory short electrospray bursts. The disclosed invention is not so limited.

BRIEF DESCRIPTION OF THE DISCLOSED INVENTION

An essential element for paper and paper-like substrate based electrosprays is that the spray fluid must be able to wet the substrate, and permit free wicking of the fluid over the substrate itself. Any contact along the surface of the substrate media, whether hydrophilic or hydrophobic in nature, can interrupt the capillarity of the fluid and thus cause any spray to cease or at the very least, be substantially diminished. If the substrate is held using an alligator clip at one point or points, the media substrate will be able to spray. However, using an alligator clip or clips is labor intensive and awkward. In one design, a series of sharp pointed polymer standoffs is employed in a plastic cassette to support the substrate media. In contact with the substrate is a metal ball used to provide an electrical contact point. The radius of curvature of the ball is such that capillarity is not impaired due to the minimal contact area of the ball and the substrate. However, the combined device requires an enclosure or cassette that is nearly half an inch thick and is expensive to fabricate and assemble. Furthermore, the cassette device used in a mass spectrometric application requires several steps of processing to spray. In the first step, the cassette is load onto a turntable where a bar code is scanned for patient information. The turntable is now rotated to a new station where spray fluid is added. The turntable is now rotated to a spray position in front of the mass spectrometer head. The final position of rotation is for the discarding of the cassette. The process can then be repeated. The large form factor of the cassette limits the number of samples that can be analyzed in a cassette magazine. The finite amount of spray fluid also limits the duration of the spray. Longer sprays are required in some cases to allow for target analytes of interest to elute from the substrate media before they can leave the substrate as electrospray droplets.

The disclosed invention does not require alligator clips, polymer clip or polymer or dielectric insulator standoffs to support and hold the substrate media. Instead, it was discovered that a wire screen mesh sandwiching the substrate media can be used in the preferred embodiment to hold the substrate, without impeding capillarity of a wetting solvent spray fluid applied to the substrate. A further benefit is that electrical contact can be made to the substrate. Yet another benefit is that the substrate and wire mesh can be further enclosed in a polymer or other insulating sleeve that is flat and very thin, much thinner than the cassette approach being pursued in the prior art. The preferred form factor is very similar to that of a credit card, hereafter referred to as a DBS Card. The advantage of a flat form factor is that samples can be more easily mailed in an envelope, more samples can be stored atop one another, and more samples can be loaded into a magazine for automated analysis in the same area than prior art cassette systems. As such, the substrate or paper media and conductive wire mesh screen form a new combination of media substrate and conductive screen material.

In the preferred embodiment, the card holds the substrate between two layers of conductive mesh, the mesh being plated polymer or conductive wire, ideally inert chemically with respect to the analyte being investigated made into a stationary phase on the substrate media. The screen or mesh preferably has a circular opening located directly over section of the substrate media. The circular opening permits the application of analyte to the substrate. In the preferred embodiment, the analyte is whole blood. When placed on the substrate, the analyte becomes a dried blood spot or DBS. In other embodiments, the term DBS is meant to represent Dried Biological Sample. The application of spray fluid solvent can pass directly through the screen. The disclosed invention is designed to be inserted into a holder with a slot provided for that purpose. Located directly over the wire mesh portion of the DBS Card is the fluid feed orifice. The orifice in the holder is designed to be a diameter larger than the meniscus of any drop. The purpose of this is to preclude fluid contact with the walls of the card slot holder. Contact with the wall would result in fluid being wicked away and thus not be available to wet the substrate media. The disclosed design allows for continuous and effective spray fluid application to the substrate.

In yet another embodiment of the disclosed invention, in applications such as electrospray extraction of dried analytes on substrates such as paper or other suitable media, a means has been discovered which does not require an external counter electrode to produce electrospray operation. In the disclosed design, the substrate media sharp tip from which an electrospray would emerge is situated at a location behind the edge of the card or holder. At the edge of the card or holder is a wire, which is positioned such that it covers the gap in the card or holder between which the aforementioned substrate is placed. The wire preferably has a kink or bend in the center of it located directly away from, and in front of, the axis of the substrate sharp end tip. The wire is designed to serve as the counter electrode with respect to the potential applied to the mesh and substrate combination. As a result, an electrospray will be formed, and resolubilized analyte fluid will accumulate at the bend or kink on the wire electrode, being held in place by surface tension, up to and until the volume becomes so great that the fluid drops into a waiting collection vessel.

In the preferred embodiment of the DBS Card used for mass spectrometry or other analytical method, the thickness of the mesh mitigates direct finger contact with the substrate, yet permits optical interrogation of the dried blood spot. In the Purdue University cassette version of a paper based electrospray system, a precise volume of blood must be applied to the substrate media, yet in the disclosed invention, variations of blood volume may be applied as in the preferred embodiment a CCD image capture of the blood area seen above and below the substrate media permits a computerized optical integration of blood volume not anticipated or possible using the prior art cassette system.

In the preferred embodiment, the DBS card will have a bar code or bar codes, either 2D or 3D, to identify patient and card lot, dates, and other requisite data. In addition, provision has been made for a RFID chip to be contained in the plastic DBS Card sleeve. As a result, the card can be 'read' optically and wirelessly.

In summation, the disclosed invention provides a simpler, more effective, more compact, less expensive form factor than the prior art for paper based mass spectrometry. The disclosed invention combines a mesh holder of a wicking substrate media with an electrical contact. The disclosed invention allows for finite and continuous sprays. The disclosed invention allows for optical interrogation of the analyte, preferably a dried blood spot whereas the prior art does not have such a provision. The disclosed invention allows for fewer processing steps to achieve the same result over the prior art.

DETAILED DESCRIPTION OF DISCLOSED INVENTION

The invention employs preferably a paper substrate upon which a dessicated analyte, preferably biological, has been deposited. The paper is cut to a sharp tip so as to create an electrical field concentration point, with an opposite end preferably cut square, allowing sufficient space between the tip and the square end to place preferably 1 ml of a preferably biological or forensic sample upon which can be dried. The paper is preferably long enough between the aforementioned dried sample and the tip and the square cut end to allow a support structure, preferably a conductive mesh, to be affixed. The mesh can be a conductive polymer, a polymer coated or treated to be conductive, or a conductive wire mesh screen. The wire mesh is preferably a 40 mesh, and is preferably stapled to the sample paper using preferably a chemically inert stainless steel staple. The screen is preferably wide enough that it can be in turn stapled to a surrounding support structure, in this case, preferably a polymer dielectric credit card like structure. Overall, the sample collection surface and support structure creates a flat form factor.

The challenges in creating a paper spray using electrospray require that the paper have sufficient conductive fluid available to the paper wicking media. Soaking and saturating the paper is not enough. There must be a surplus of fluid available to produce a spray. An applied field to the paper will draw away fluid once a Taylor Cone and hence an electrospray is formed. Once that fluid surplus is exhausted, the spray will cease. According to John Fenn, if the paper is inserted into a reservoir of suitable spray fluid, the paper will act as a wick and draw the necessary fluid from the reservoir into the paper and allow that fluid to transition into a spray. The fluid reservoir must however keep up with any evaporative losses from the surface of the paper, which as essentially a two dimensional structure, has a large surface area for evaporation. Assuming that enough fluid is available, the spray will continue indefinitely. However, as those skilled in the art have learned, it is not always easy or convenient to provide a spray reservoir for paper spray mechanisms. As such, it has become commonplace to drip a surplus fluid volume directly onto the paper substrate to allow enough fluid to be available for electrospray operation. Typically, such paper is supported using an alligator clip. The clip serves as a support structure and a pole of a power supply used to create an electrical field between the paper sharp tip and an opposing pole-electrode. The clip is preferably metallic and thus electrically conductive, and owing to a small contact footprint and the mildly hydrophobic nature of most metals, does not typically draw away and spray fluid due to capillary action. As capillary action is the dominant force in allowing fluid transport within paper spray applications, avoiding contact with any surface that could draw or attract away the spray fluid is essential.

To transition paper spray out of the laboratory and into the clinical environment, some means is required to support the paper, make electrical contact with the paper, and to preclude any precious spray fluid from being wicked away. At this point, some discussion of capillary action and wicking is in order. Fluid of like molecules exhibits a property of like attraction, known as cohesive forces. Sometimes, when fluids come into contact with a dissimilar material, depending on that dissimilar material surface structure and composition, the fluid will be attracted to the surface. This effect is known as adhesion. In electrospray, a jet of fluid will emerge from a conductive fluid surface when the electric field overcomes the surface tension of the spray fluid. Wicking within the paper occurs because there are voids within the paper structure itself that attract fluid due to these adhesive forces. Fluid moving into these voids or channels draws additional fluid with it because of the fluid's cohesive properties. Not all materials that can wick have to have voids that can be described as porous however. Strai along the surface of a material can foster capillary effects just as well as materials that contain voids that penetrate the media. In liquid metal ion sources used in, space propulsion, solid metallic needles are employed which have been etched so as to form surface channels or stria. Indeed, all that is required for capillary action is a surface upon which adhesion can occur. However, for capillary forces to transport fluid any great distances, a complementary surface that allows for adhesion needs to be in close proximity to another such surfaces. The combination of surfaces allows for rapid capillary effects. This is easily observed between two paint brush hairs. One paint brush hair can soak up some fluid, but two hairs close together draws fluid very quickly.

Capillary action is observed in many analytical applications, such as thin layer chromatography, in which a solvent moves vertically up a plate via capillary action. Dissolved solutes travel with the solvent at various speeds depending on their affinity for the solvent (the mobile phase) or the absorbent coating on the plate (the stationary phase).

In a paper spray application for practical applications, a means of supporting the paper are necessary. The paper can be supported using the previously mentioned alligator clip. Or it can be supported using a series of wires fore and aft holding the paper from above. A pin can be pushed through the paper with the head below and the sharp pointed supported above the paper. Other variations of such support will be obvious to those skilled in the art. In any case, support of the paper from above rather than below is essential because any support below the paper, even if such support is hydrophobic, can and will have the potential to permit some fluid adhesion. When any fluid adheres to a support structure, the volume of the fluid will increase until the weight of that fluid will cause the fluid to drain away over the support structure. Once a path is established for fluid to be drained away, the surplus of fluid in the paper will diminish to the point where an electrospray cannot be maintained or created. A continuous spray is essential for electrospray in many paper applications, but especially so for analytical applications. This is because it takes time for a dessicated sample to become resolubilized and the target analytes of interest to elute out of the sample and become available for identification. The difficulty of supporting a paper spray source and electrospraying is exemplified in the patent of Cooks et al where the inventors stipulate in the specification that the spray extinguishes after a few seconds after a drop of spray fluid is applied to the paper. In another mode of spraying, that same specification states that most of the fluid appeared to be moving over the paper surface rather than trough the paper. Fluid moving over the surface does not permit some or part of the analytes contained in a dessicated sample to be recovered. Furthermore, a few seconds of spray does not reveal all of the analytical components with the sample. In Cooks et al, the inventors state that the few seconds of spray does provide enough ions for several minutes of mass spectrometer analysis. However this statement clearly represents that a surplus of initial analyte alone is available, and does not provide any means for the recovery and identification of larger molecules of diagnostic importance that have yet to elute from the dried sample. Difficulties in maintaining a spray in Cooks et al can be traced to the type of support structure provided in the Purdue patent disclosure. The paper is support from below using a polymer structure that can provide a path for spray fluid to wick away, thus precluding continuous spray operation. Indeed, in the Purdue patent application, the inventors stipulate that an electrospray cannot be actually seen. The presence of a short burst of ions being the sole belief that electrospray is in fact transpiring. What is actually occurring in the Purdue system is not electrospray, but "field desorption". Field desorption or field ionization is a form of soft ionization in the absence of a Taylor Cone and actual electrospray. While electrospray mass spectrometry is routinely used for analysis of small and macromolecules, field desorption or field ionization is generally limited to small molecular identification. As a consequence, the Purdue approach is limited in its analytical utility. The disclosed invention is not so compromised.

The disclosed invention supports the paper substrate from above using the nested cell structure afforded by a wire mesh screen. The adhesive properties of the spray fluid are attracted to, and along the wire structure. However, the closed cells inherent is a square mesh, and it would be obvious to those skilled in the art to use circular or honeycomb cell shapes, provides multiple adhesive surfaces that restrict fluid to the cell itself, where cohesive and adhesive properties together work to build up a fluid reserve that ceases as soon as the cohesive properties are balanced by gravitational and/or applied electric fields or effects.

The fluid contained in the cells is thus restricted to those mesh cells located over and in contact with, the paper substrate. Outside of the paper, no fluid flows. Stapling the paper to this mesh, with the mesh placed on the top surface of the paper with respect to gravity, provides a stable platform for continuous electrospray. As such, the support structure provides support, paper alignment, electrical contact, and a fluid reservoir derived from fluid that can drip and pass through the wire mesh screen.

In some applications, such as space or zero-g, the preferred embodiment of the disclosed invention will not operate. To accomplish this without the benefit of gravity, the disclosed invention can be modified to provide a potential difference between the spray fluid source and the paper and from the paper to an opposing electrode. Fluid from the spray reservoir will be drawn from the reservoir not by gravity, but by electrical attraction to the paper surface. The fluid in the paper will in turn be attracted and sprayed from the paper by the field existing between the paper and the opposing electrode. This is depicted in FIG. 2.

In Cooks et al, claims are made regarding the mass spectrometric detection of pathogens such as bacteria. The sheer size and mass of bacteria alone make identification based solely on mass or charge-to-mass ratio alone highly error prone, as the complex spectra alone can overlap many compounds of combination. Indeed, one has only to refer to the field of proteomics to understand why peptide mass finger printing is necessary because proteins themselves can be very massive and complex. In ion trap mass spectrometers, one often must resort to a series of ion fragmentation cycles to try to approximate possible constituents of the original species for identification. A bacterium contains many proteins and enzymes not to mention the plethora of chemicals contained therein. Even if one were able to sequence all of the contents of a pathogen for identification, the contents would need to be available for study. No where in Cooks et al is there mention of lysing the pathogen to aid in analyzing the contents. In fact, the specification and claims punt to analyzing a complete pathogen species. In the disclosed invention, a lying agent is added to the paper so that upon application, the pathogen is opened and contents are released. In addition, the spray fluid contains a lysing agent. Typical lysing can be accomplished by using HEPES or Glucose: 50 mM, Tris. CI (pH 8.0): 25 mM, EDTA (pH 8.0): 10 mM Detergents like SDS, TritonX-100 can be used. The cell lysis buffer can contain tris, glycerol, lysozyme, proteinase K, NaOH. B-PER Solutions B-PER Bacterial Protein Extraction Reagents gently lyse *E. coli* and other species of bacterial cells and effectively extract soluble native and recombinant proteins. B-PER Reagents have been used for Gram (−) bacteria, *S. aureus, H. pylori* and *E. coli* strains BL21(D3), JM109, DH5a and M15. The reagent is also suitable for certain Archaebacteria species and cultured insect cells. Extraction does not require expensive equipment and can be performed in less than 10 minutes. B-PER Reagent removes soluble protein from inclusion bodies and can be used to purify intact inclusion bodies whose less soluble proteins can be extracted by other means.

Several different ready-to-use formulations of B-PER Reagent are available for different lysis needs. These include formulations in Tris buffer or PBS, and those with and without Lysozyme and DNase I enzymes. The B-PER Direct Formulation is optimized for direct (homogenous) lysis of cells in 96-well culture plates, facilitating high throughput screening assay.

In the disclosed invention, the mass of the constituents of a pathogen in combination with enhanced Raman Spectroscopy is employed. The use of Raman optical data in conjunction with mass or charge/mass data allows for a more accurate identification of trace pathogenic species to be identified. The determination of Gram Positive and Gram Negative species can also be accomplished. Surface-enhanced Raman spectroscopy or surface-enhanced Raman scattering (SERS) is a surface-sensitive technique that enhances Raman scattering by molecules adsorbed on rough metal surfaces or by nanostructures such as plasmonic-magnetic silica nanotubes. The enhancement factor can be as much as $10^{10}$ to $10^{11}$, which means the technique may detect single molecules.

Paper Spray with Hydrophobic Support

In another adaptation of the disclosed invention, if a paper or similar wetting substrate or paper or similar material is combined with hydrophobic layer preferably placed on the lower side of the wetting paper or substrate, allowing the opposite or preferably top side to be wetted from a fluid source, the fluid, preferably aqueous in nature, will be unable to accumulate on the underside of the paper. This is especially important in paper electrospray applications because supporting the paper without creating a wetting path that could cause the fluid to drain away or be diverted is imperative. A path of fluid flow other than the paper itself would starve the paper apex or tip from the necessary amount of fluid to produce an electrospray, regardless of the applied voltage. A preferably plastic or polymer hydrophobic support on the lower side of the paper cut to the same shape as the paper would also protect the paper apex or tip from damaging mechanical distortions that might transpire in sample handling. A hydrophobic support would also allow the paper to be support in a carrier or enclosure that allows sample paper handling while mitigating the potential for contamination while providing for maximum paper saturation of spray fluid to produce good electrosprays.

Paper-NanoSpray

In lieu of a sharp apex created in the paper substrate necessary to create a field concentration point required to produce an electrospray, a capillary tube is affixed to the paper substrate instead. The capillary is preferably between 100 um and 300 um internal diameter, and preferably 5 mm in length, with preferably a 20 to 50 um wall thickness. The capillary is preferably made of a hydrophobic material, such as glass. The capillary may be affixed to the paper using an epoxy adhesive, or preferably physically affixed under a metal mesh attached to the paper substrate. The mesh open lattice exhibits a capillarity gradient such that fluid applied to the mesh-paper combination flows from the mesh to the paper. If a surplus of fluid will be found to reside in the mesh region. The lower side of the paper is preferably sandwiched with a hydrophobic polymer. Surplus fluid is thus attracted by capillary forces to and into the capillary tube, filling the capillary to the opposite tip. An applied electric field between the fluid mesh and the capillary exit apex will result, if the field concentration is of sufficient strength to overcome the adhesive forces of the fluid, in a Taylor Cone and thus an electrospray emission.

Figure 1:
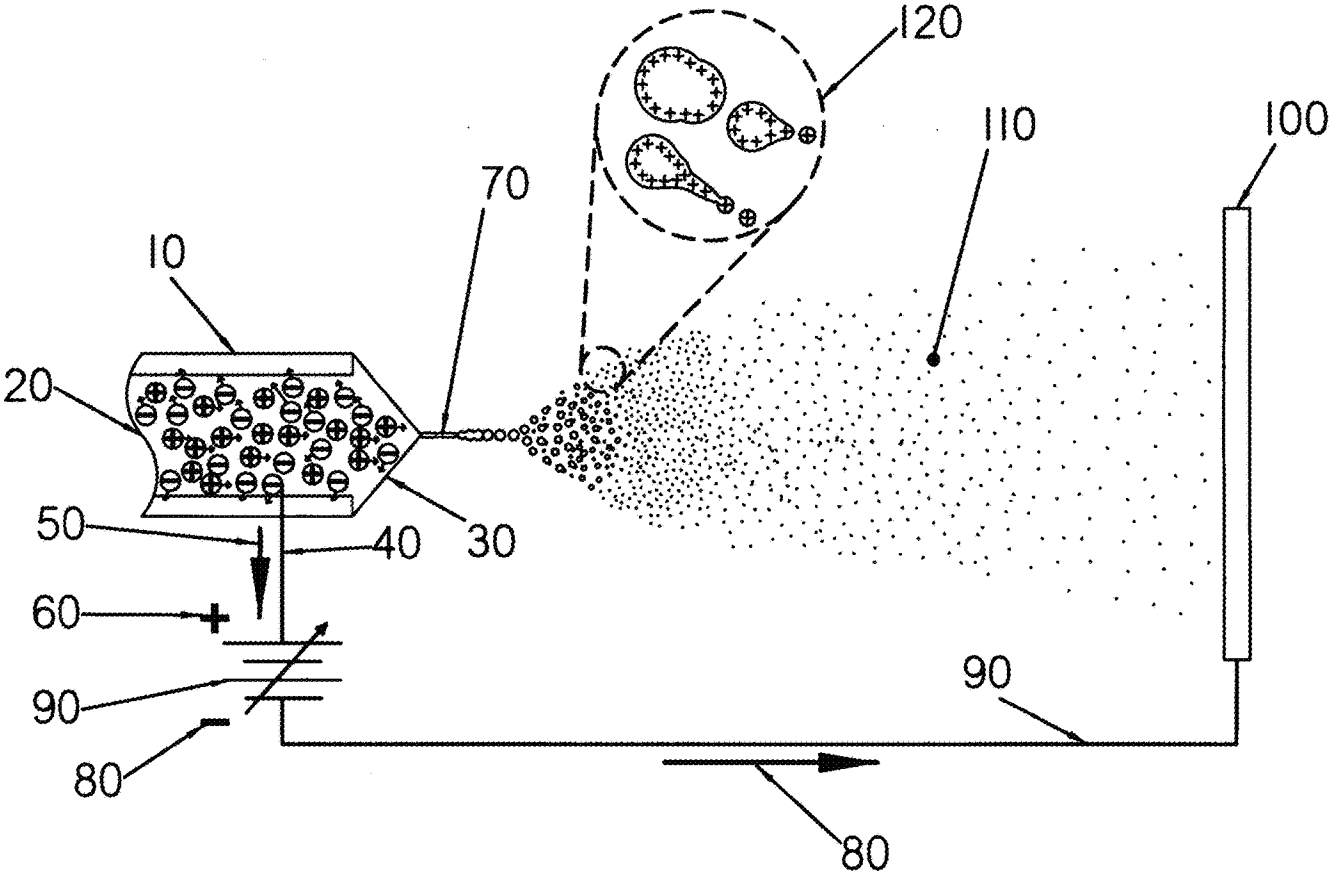
FIG. 1 shows a diagram of the electrospray process
Figure 2:
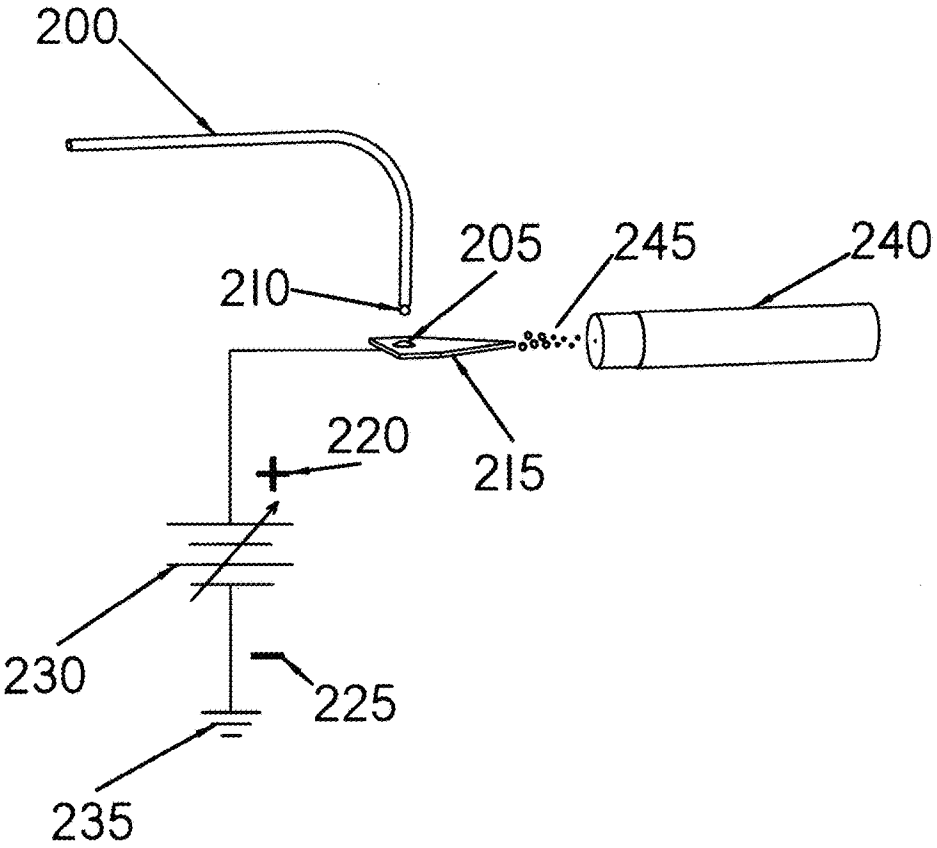
FIG. 2 shows a diagram of paper spray using the electrospray method
Figure 3:
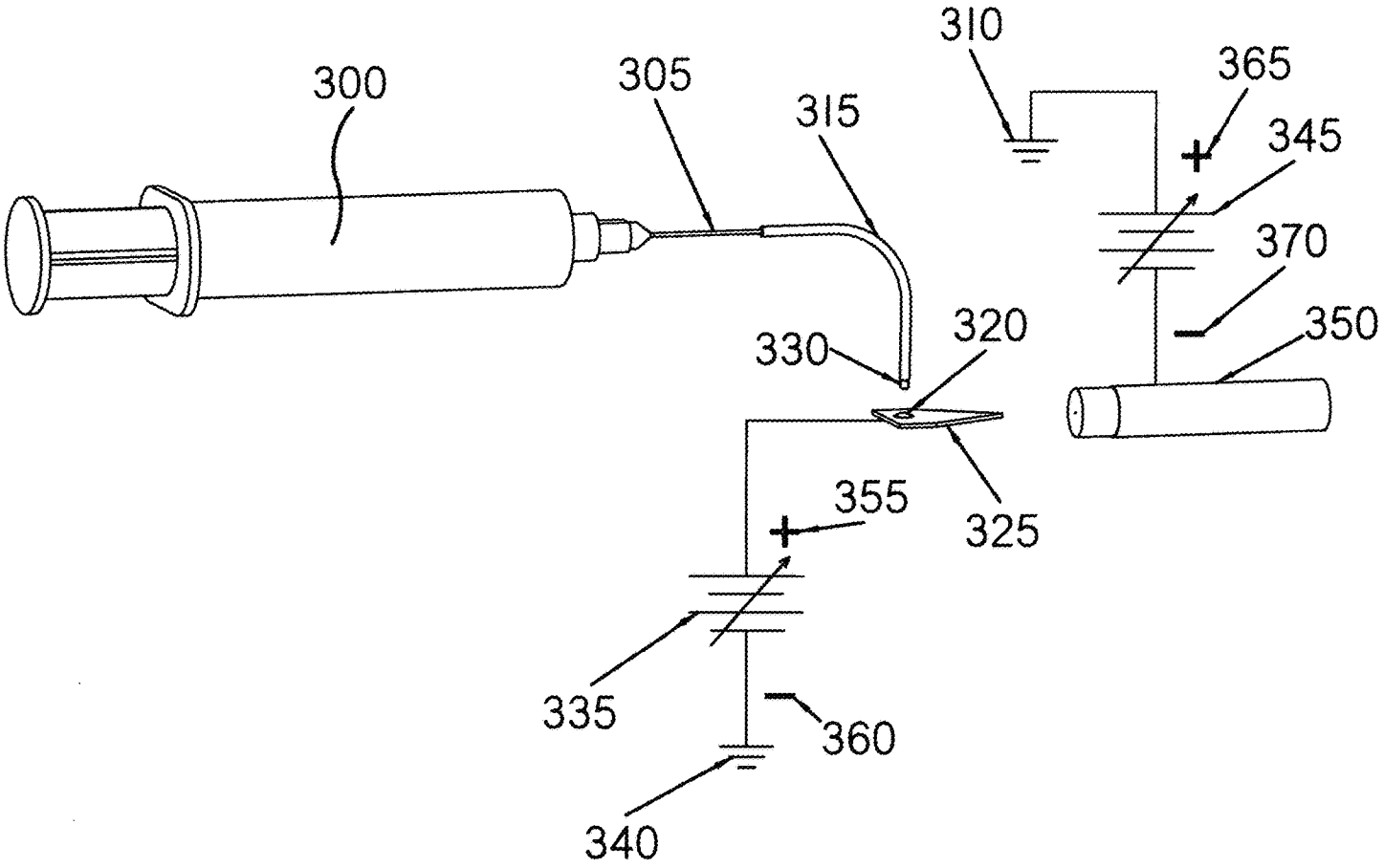
FIG. 3 is a photo of the disclosed invention consisting of a dried analyte, in this case a blood spot, affixed to a card, which is inserted into a receptacle for mass spectrometric analysis.
Figure 4:
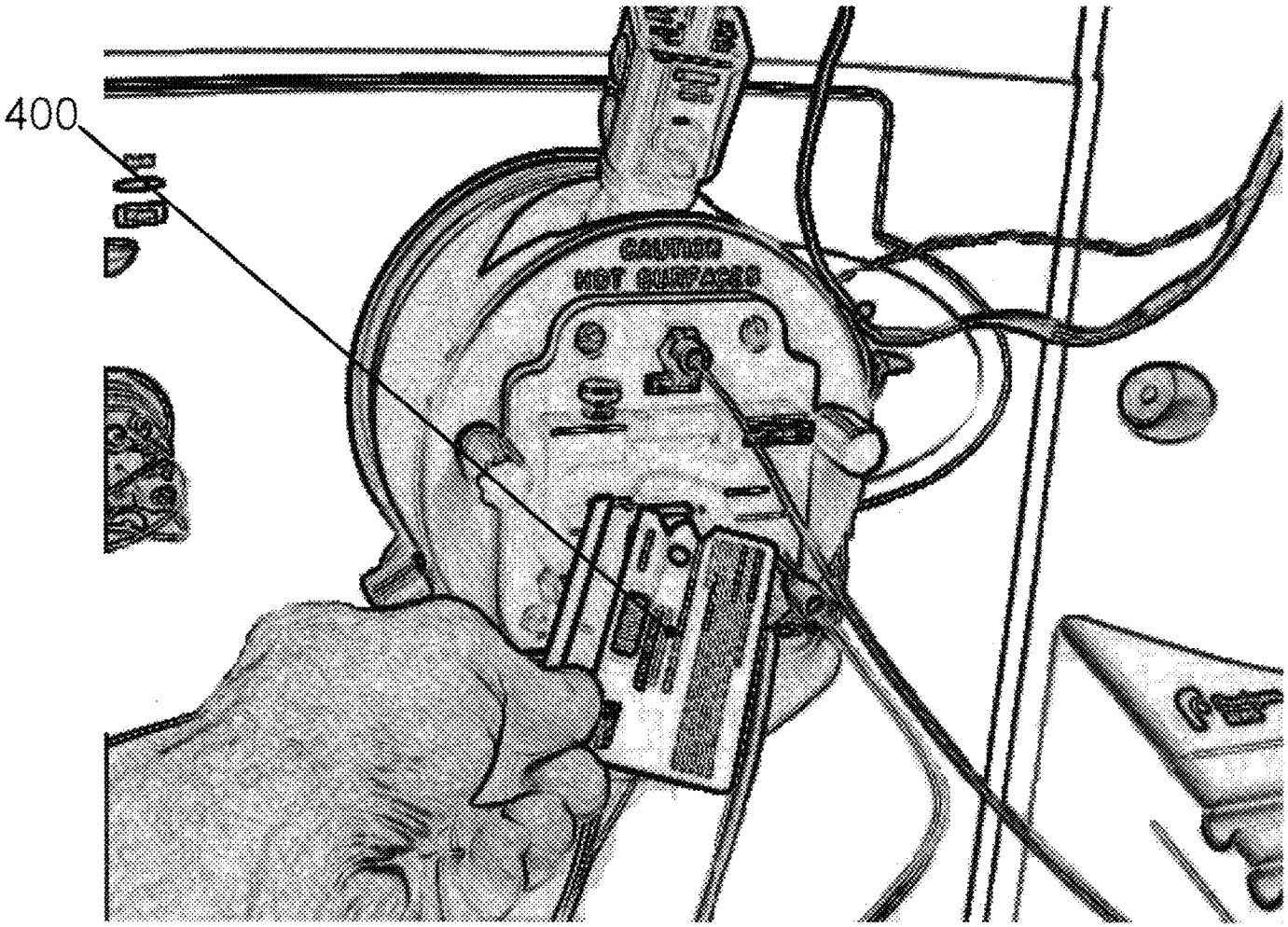
FIG. 4 is a photo of the disclosed invention analyte-card being inserted into the mass spectrometer system.
Figure 5:
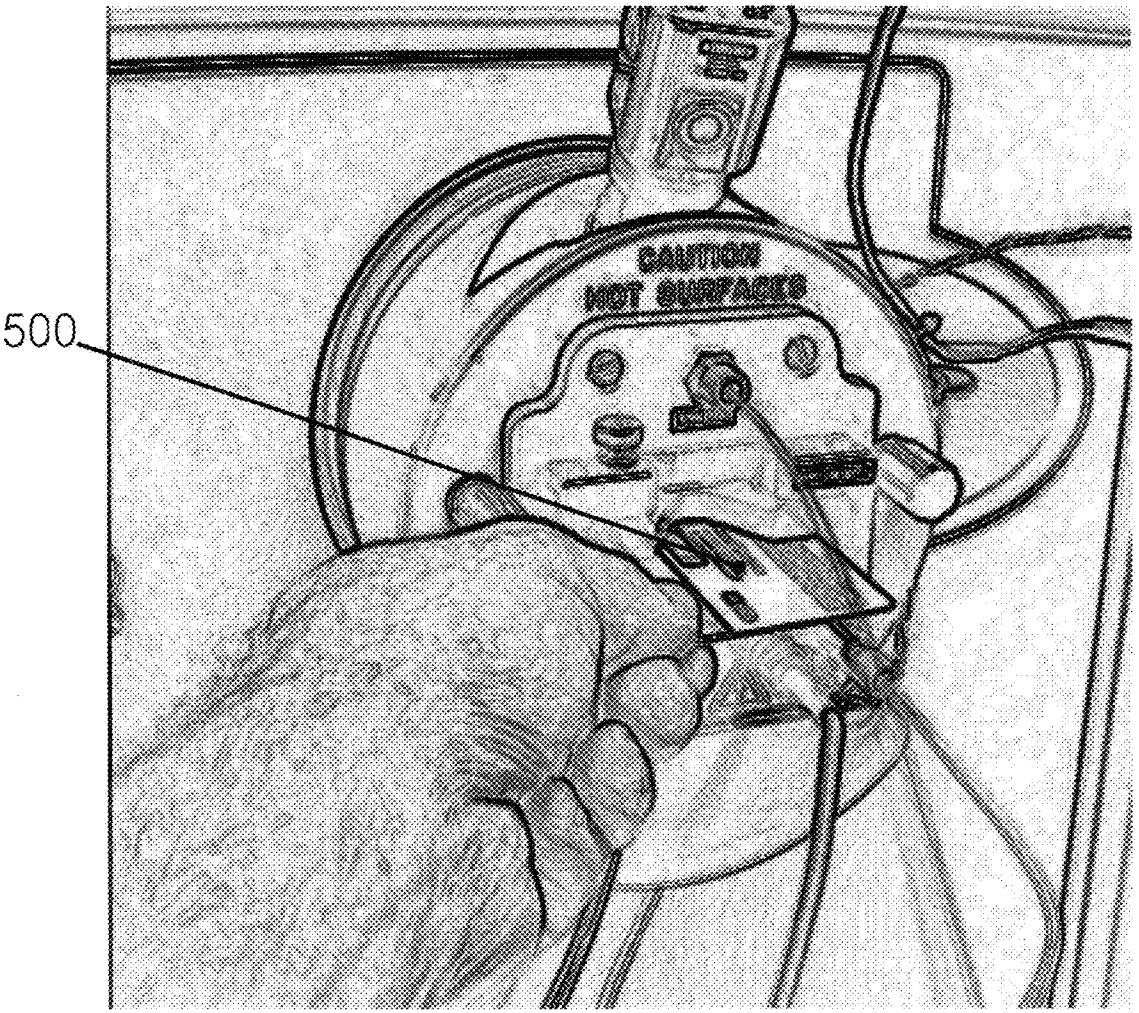
FIG. 5 is a photo of the detail of the paper spray electrospray card setup for mass spectrometric interface showing fluid feed and high voltage lines and bath gas feed.
Figure 6:
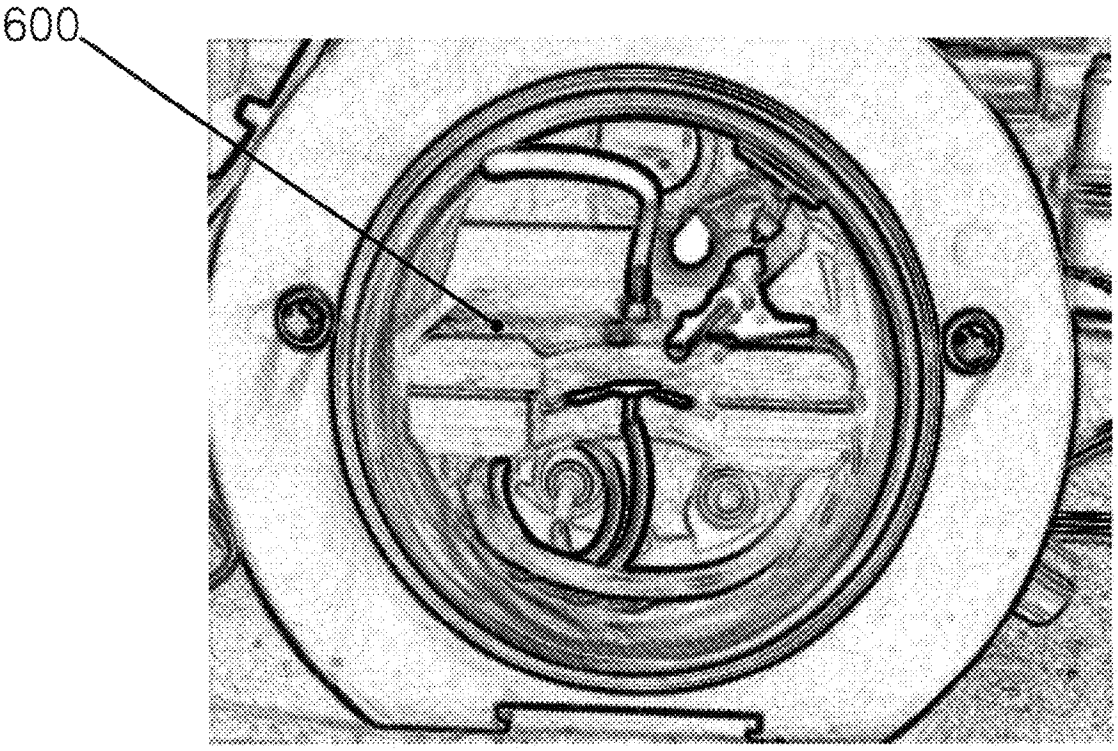
FIG. 6 is a photo of the disclosed invention paper spray card and mass spectrometer interface ready for analysis.
Figure 7:
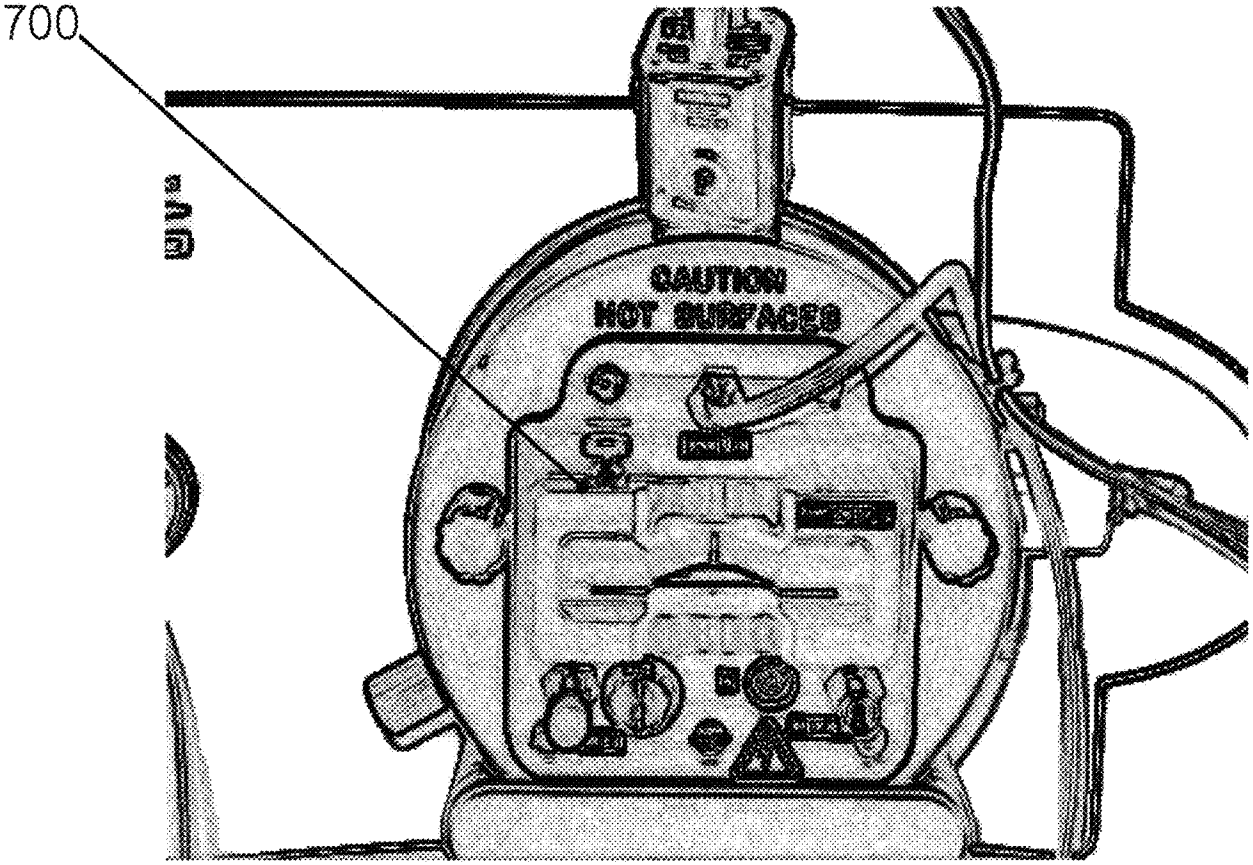
FIG. 7 is a photo of the complete disclosed invention illustrating the analyte card holder affixed over the inlet to the mass spectrometer, the mass spectrometer itself, in this case, a Finnegan LCQ Ion Trap, a monitor showing a CCD camera image of the electrospray emission from the tip of the paper-analyte combination, and the mass spectra readout on the attached computer system.
Figure 8:
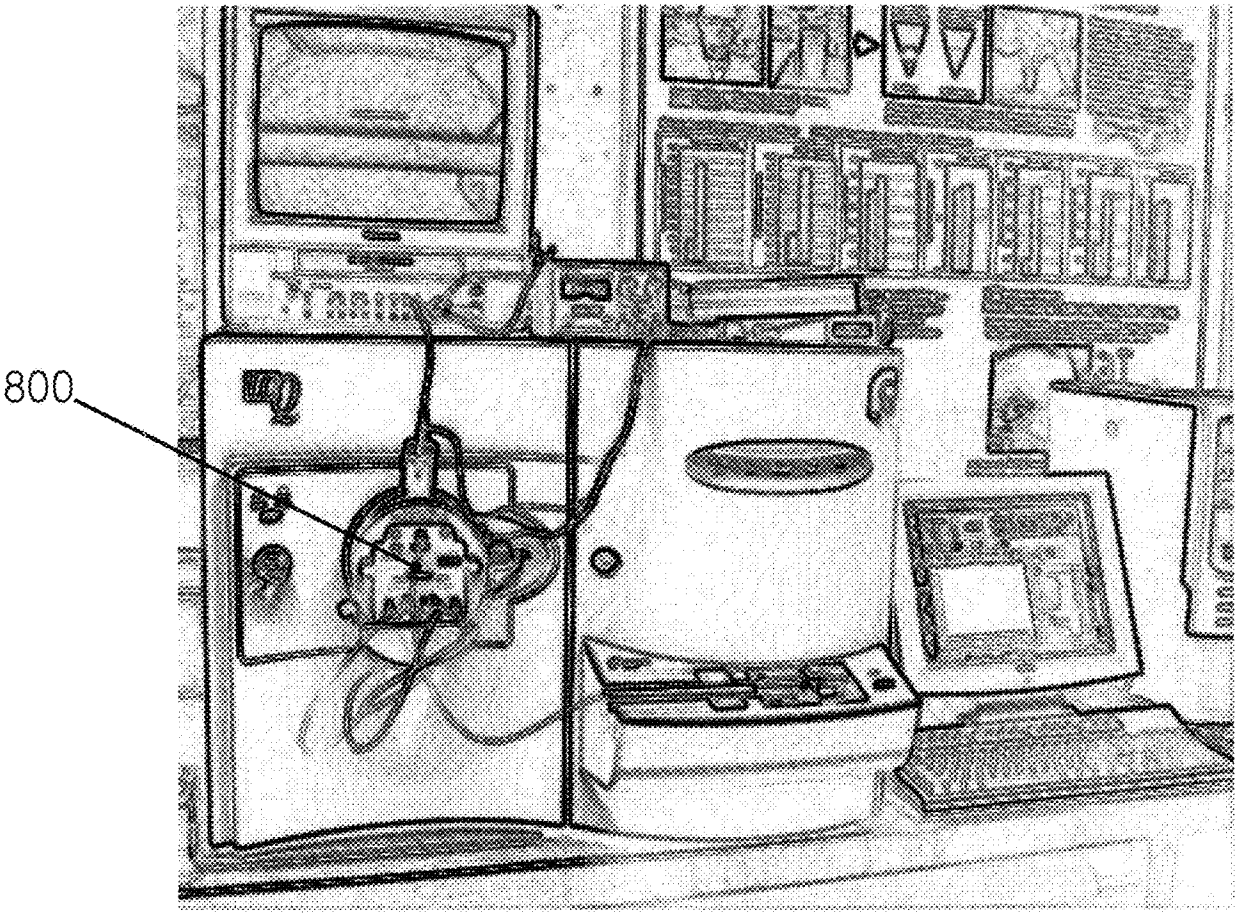
FIG. 8 is a photo of the disclosed invention preferred embodiment of the spray fluid feed system located at the top half of the card insertion holder. The image illustrates a drop of aqueous spray fluid emerging from a preferably number 18 gauge needle with a conical tip, surrounded by a housing opening with a preferably 0.280" or greater diameter. The ration of fluid needle diameter to housing diameter is configured such that the emergence of a fluid drop, with the associated cohesive properties, precludes any drop from touching the device housing. A drop touching the housing will cause the fluid to adhere to the housing and thus wick away, thus precluding fluid from reaching the analyte-paper, precluding the ability to create an electrospray and analyze the sample.
Figure 9:
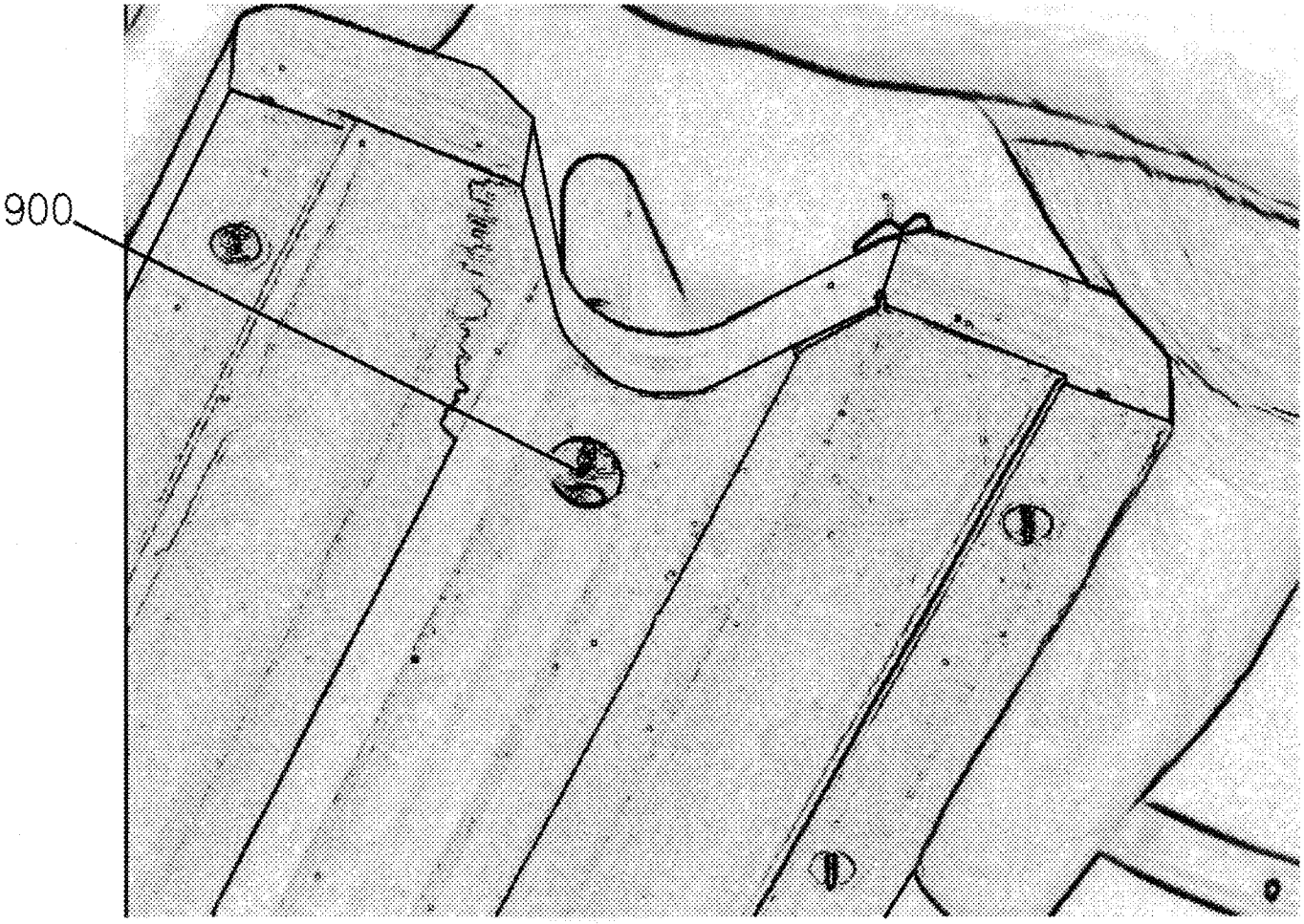
FIG. 9 is a photo of a solvent fluid drop with increased volume in contrast to the image depicted in FIG. 8, just before the weight of the drop causes the fluid to drop onto the paper-analyte located below the drop.
Figure 10:
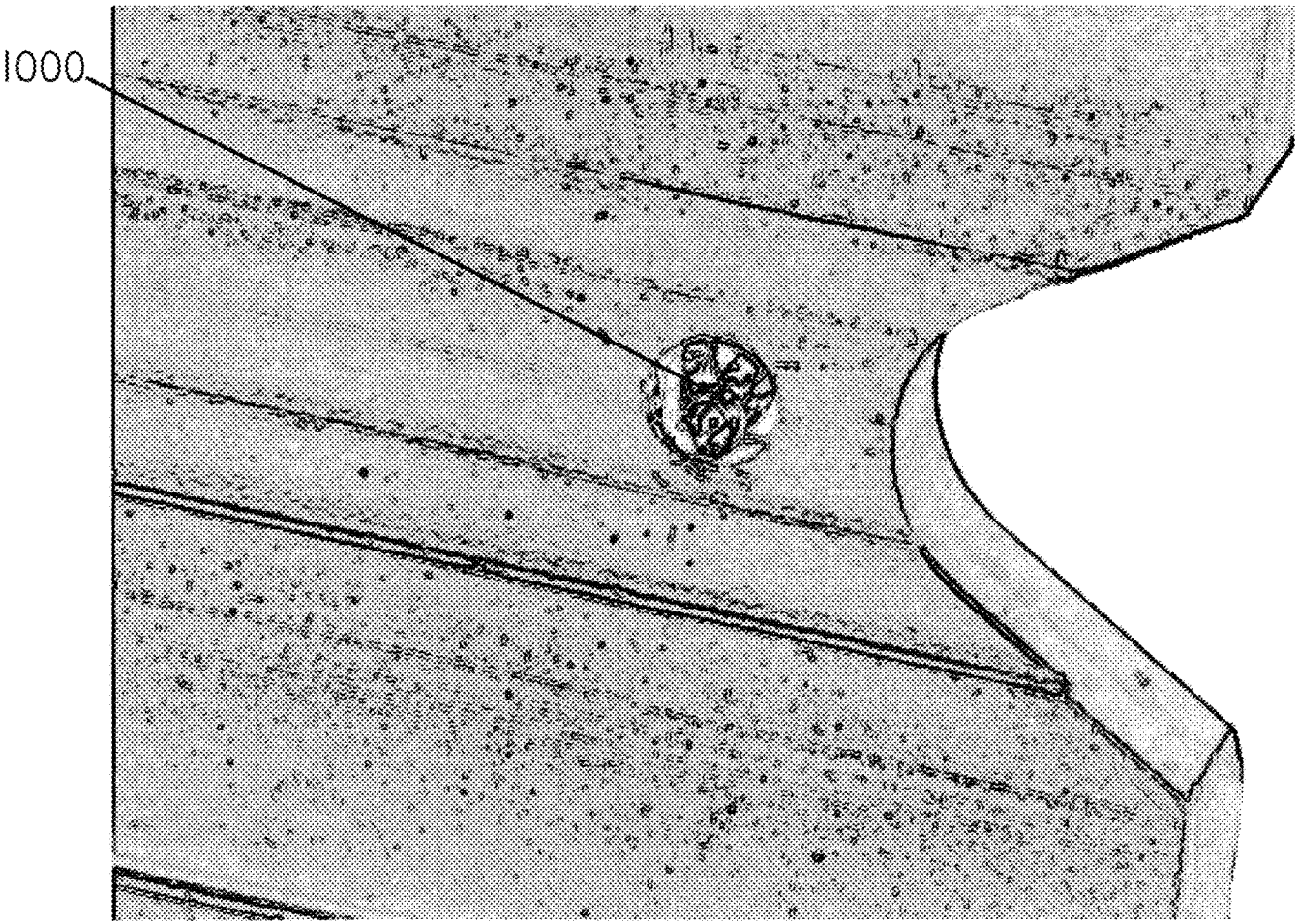
FIG. 10 is a photo of the solvent fluid drop just prior to detachment and deposit onto the paper media located below the drop.
Figure 11:
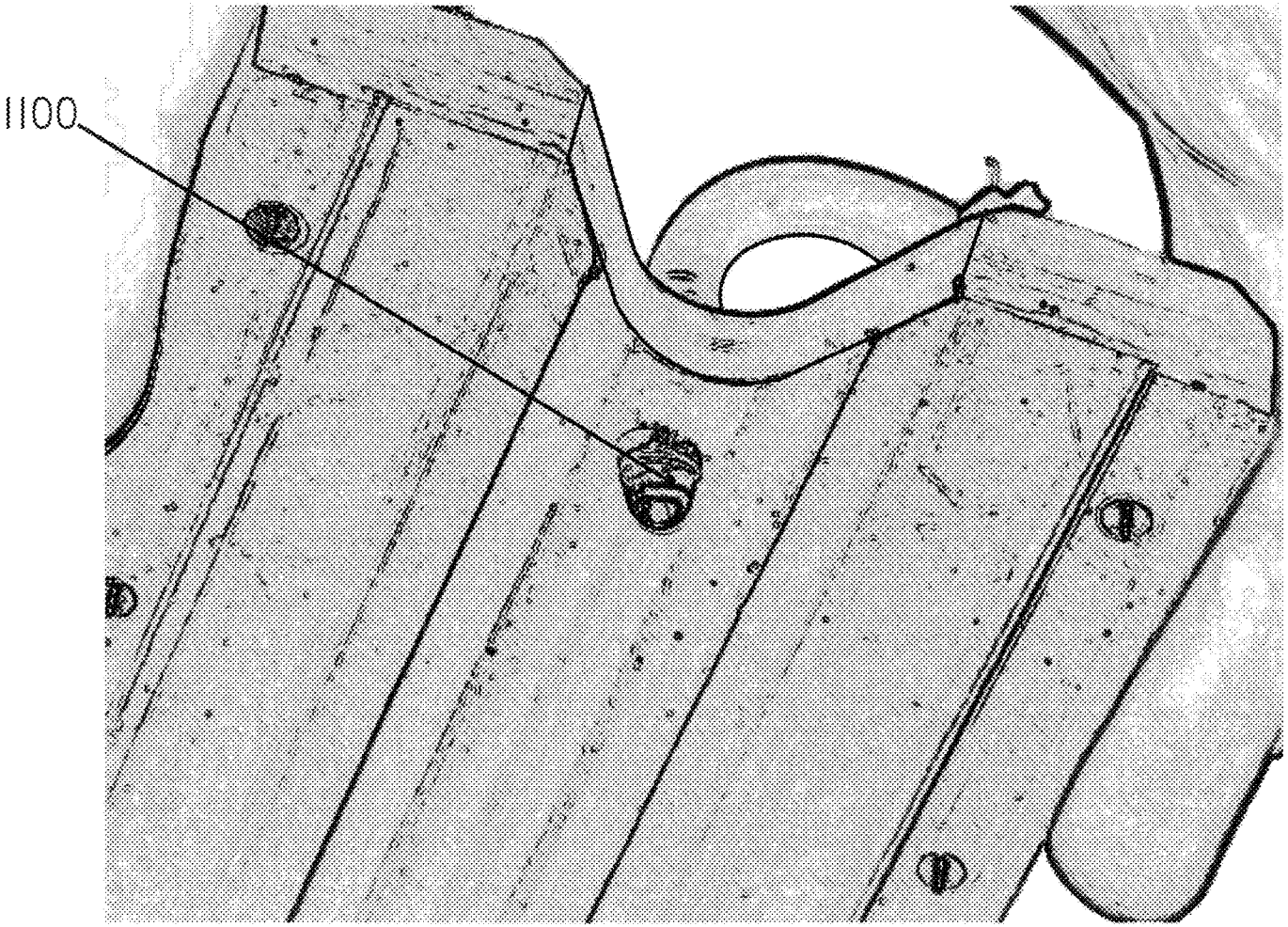
FIG. 11 is a photo of analyte-paper combination affixed to a credit-card plastic substrate, with a strip of aluminum foil attached to the paper to permit electrical contact to the paper and an external power supply used to produce electrospray operation.
Figure 12:
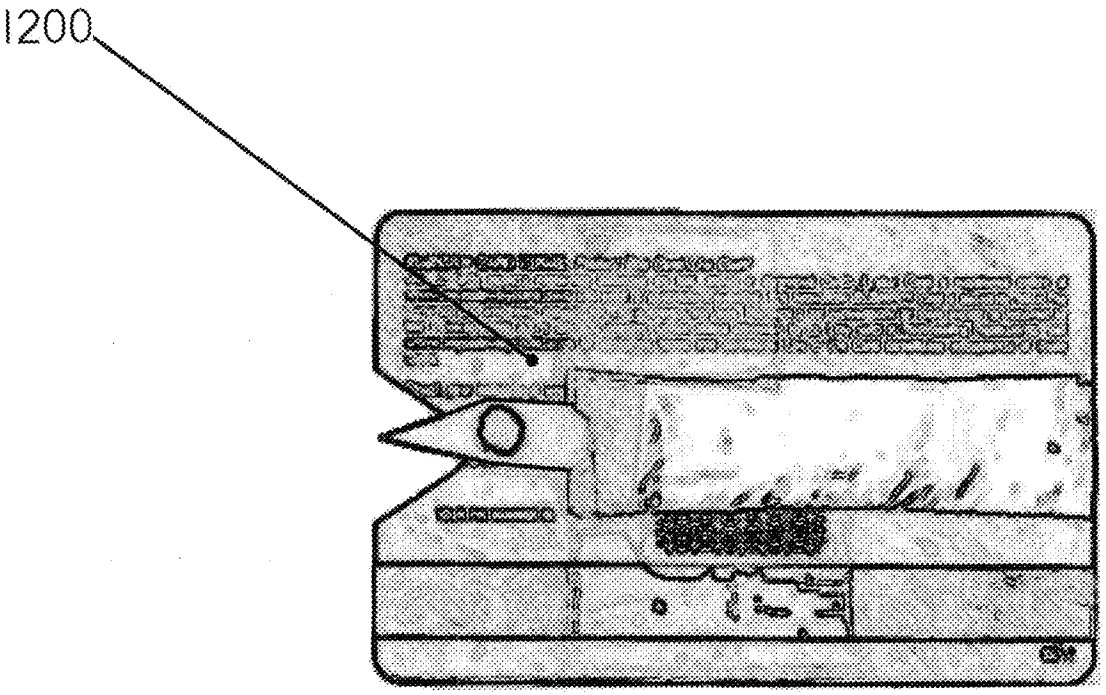
FIG. 12 is a photo of one embodiment of the disclosed invention, where a plastic credit-card substrate is used to support a wire mesh screen, said screen in turn supporting a paper-substrate used for electrospray operation. Said paper-substrate is cut to a sharp point to concentrate the electric field and produce an electrospray when a difference of potential exists between the paper-substrate saturated with a suitable conductive solution, and a counter electrode located a distance preferably within 10-20 mm from the sharp paper-substrate tip, sufficient potential difference to produce a Taylor-Cone and thus electrospray, but preferably not so great to result in a corona discharge between the paper-substrate and the opposing electrode, such opposing electrode being preferably the inlet to a mass spectrometer or other suitable analytical instrument.
Figure 13:
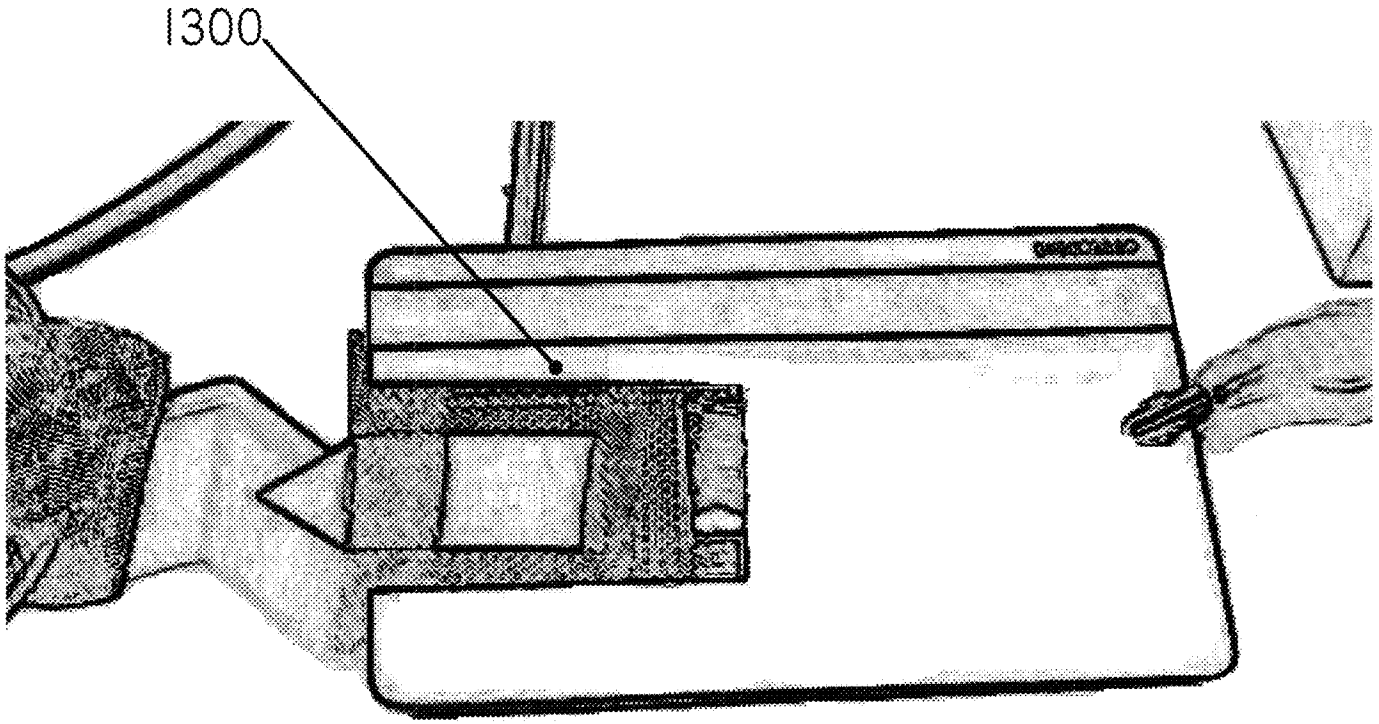
FIG. 13 is a photo of a paper-substrate spray on a polymer credit-card-like support with an integral counter-electrode. This configuration is the preferred embodiment for electrospray extraction used in wet chemistry and other non-mass spectrometric analysis techniques.
Figure 14:
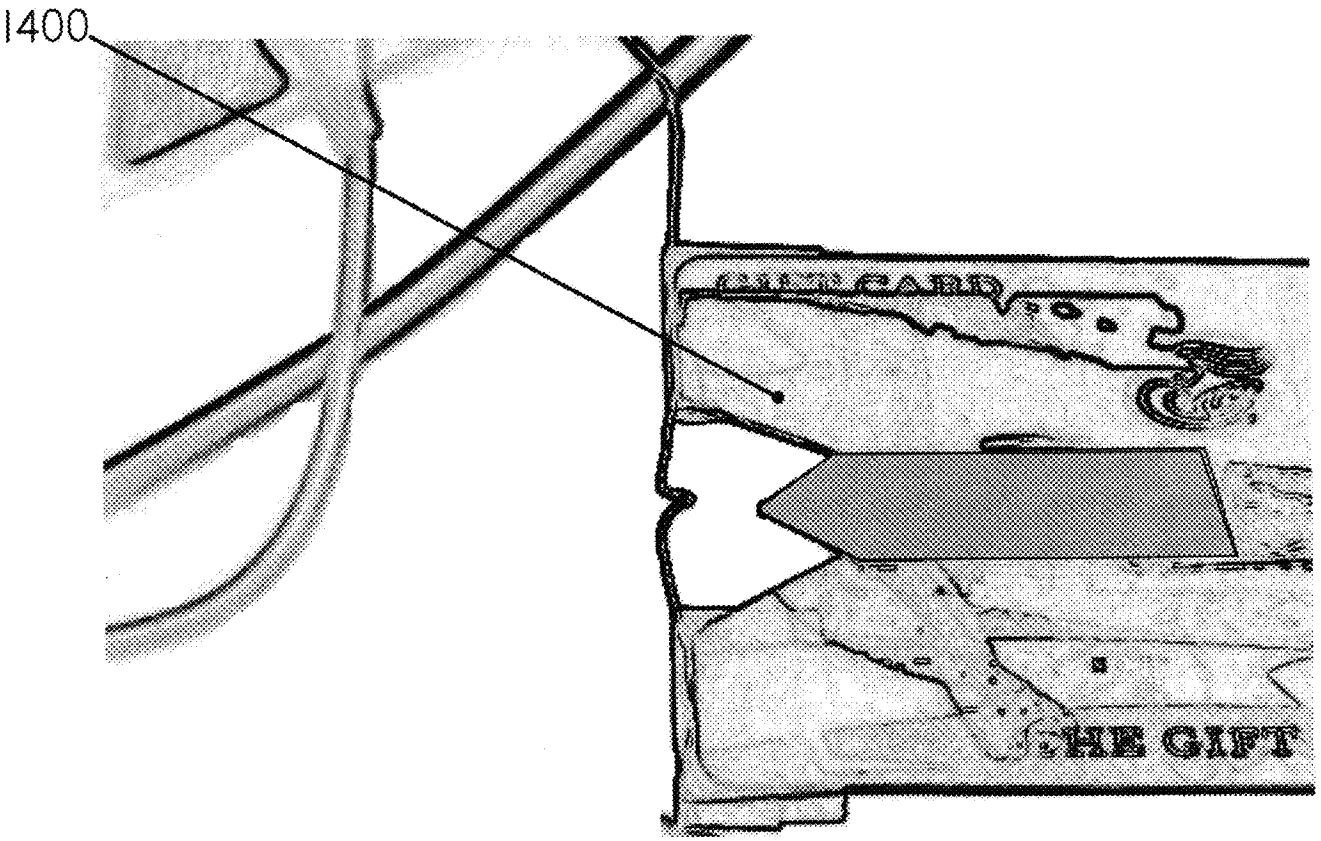
FIG. 14 shows a CAD diagram of a preferred embodiment of the paper spray-jet device with a sliding cover to protect the paper substrate from contamination or damage, and a preferred embodiment of a mailing package that can be used by a lay patient to deposit a blood spot.
Figure 15:
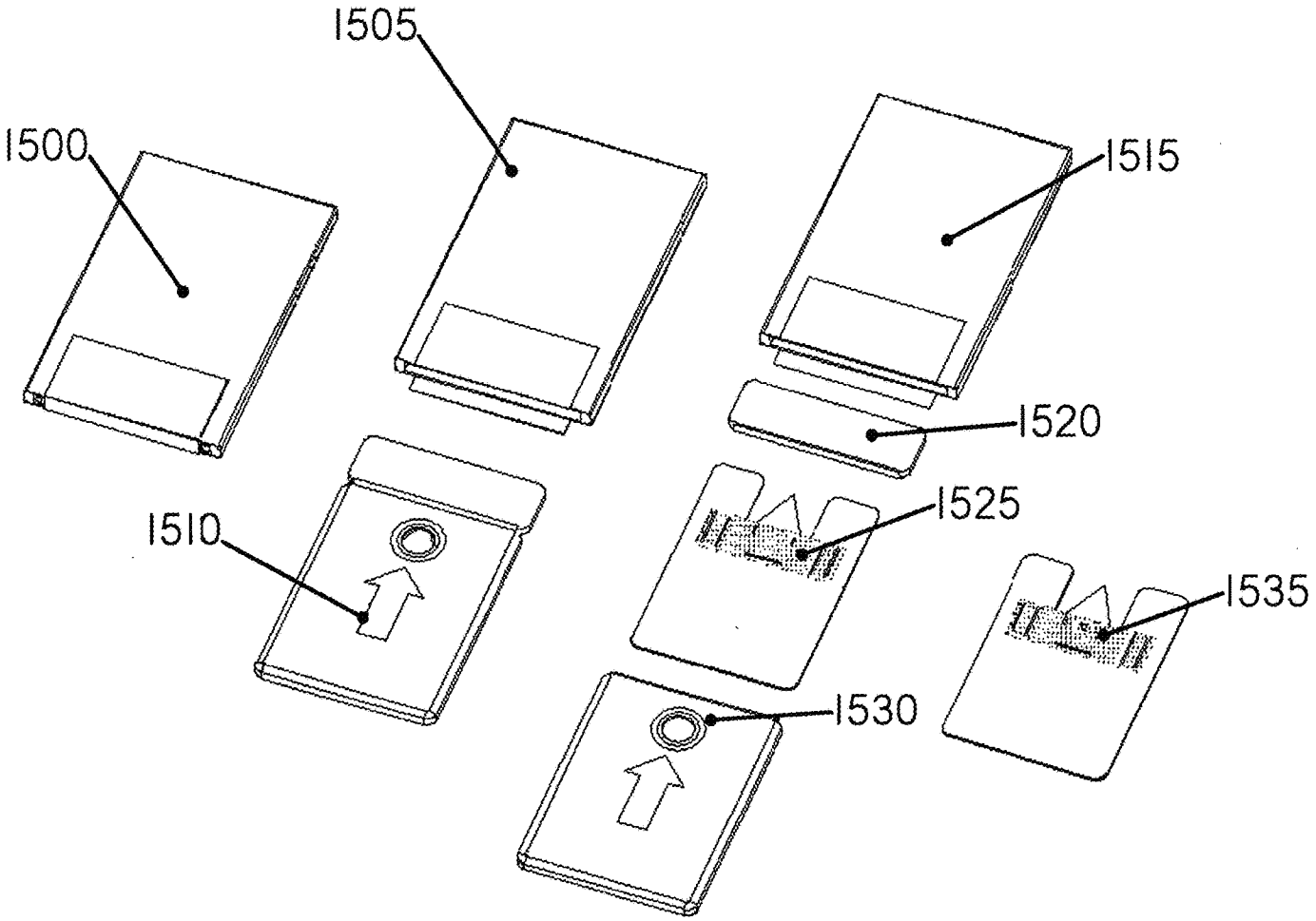
FIG. 15 shows a CAD diagram of the preferred embodiment of the paper substrate analyte electrospray source. The paper substrate is preferably affixed on the top surface by a wire mesh screen, preferably being a 40 mesh, which means 40 wires per linear inch, and attached to said screen using preferably a preferably stainless steel staple. The wire mesh screen is in turn preferably affixed to a support card, preferably being made of a polymer or plastic or other suitable dielectric, with a form-factor preferably approximating a credit card.
Figure 16:
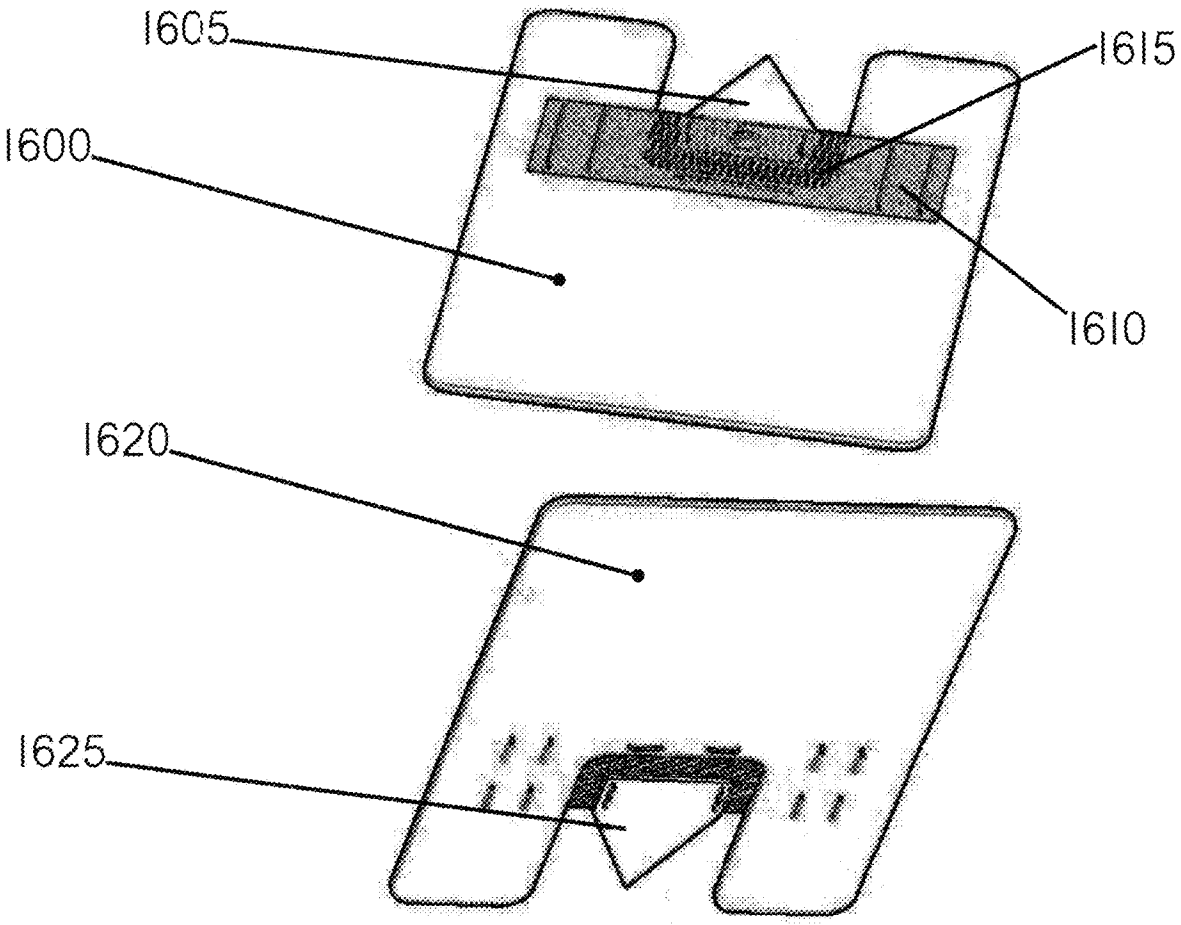
FIG. 16 is a photo of the Purdue University paper spray holder. The configuration of the holder precludes the ability to fully saturate the paper sufficiently to produce a Taylor Cone and thus an electrospray. The configuration is effective in a transitory sense for field desorption or field ionization of small molecules only.
Figure 17:
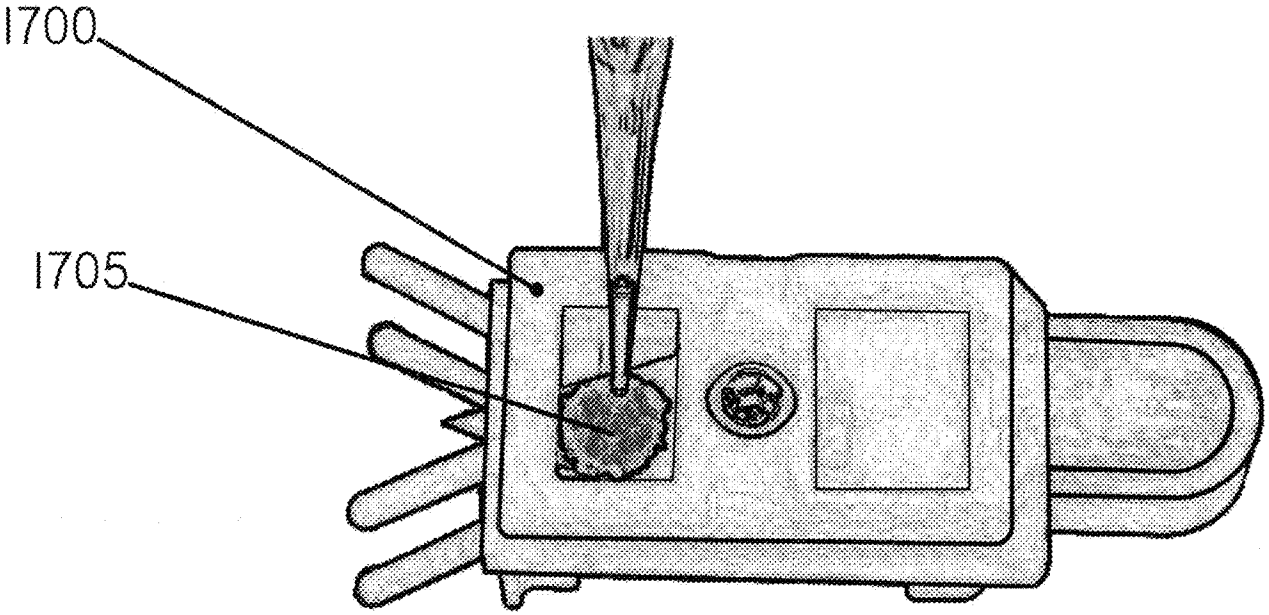
FIG. 17 is a block diagram of an aspect of the disclosed invention for a closed-loop electrospray control system.
Figure 18:
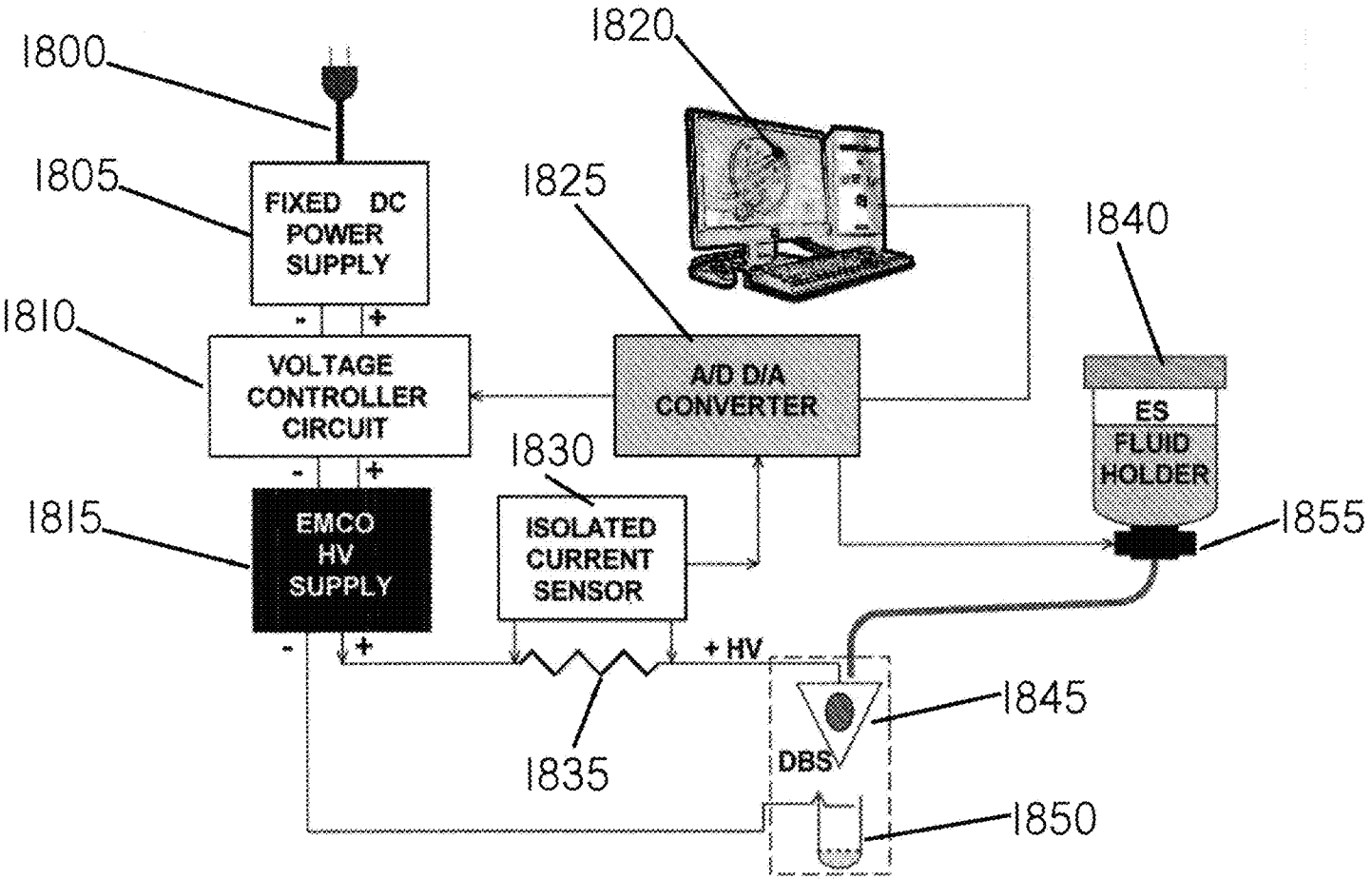
FIG. 18 is a block diagram of an aspect of the disclosed invention for a closed-loop electrospray control system where an opto-isolator is used to isolate the high voltage from the low voltage circuit sections.
Figure 19:
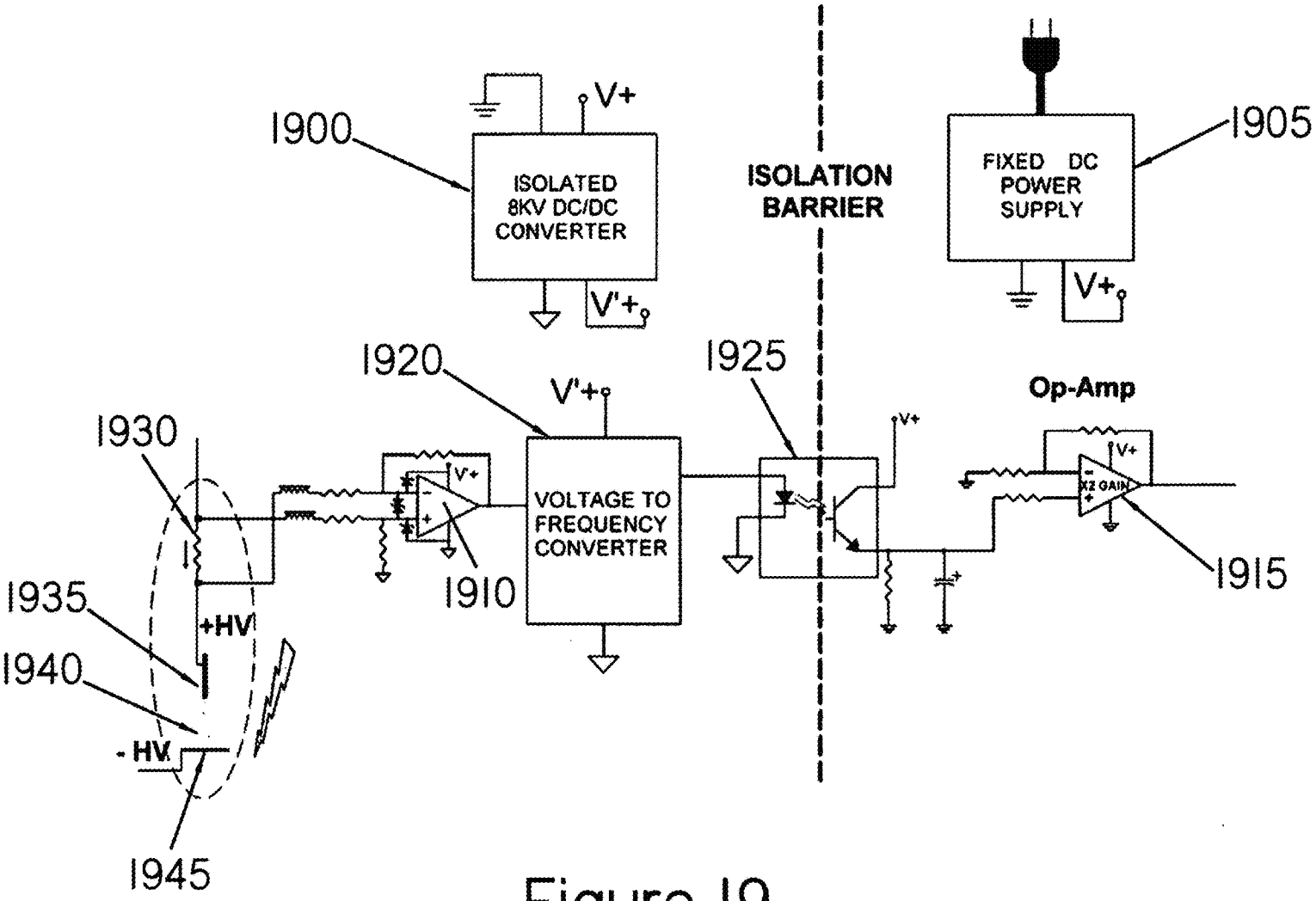
FIG. 19 is a block diagram of an aspect of the disclosed invention for a closed-loop electrospray control system where a toroid is used to isolate the high voltage from the low voltage circuit sections.
Figure 20:
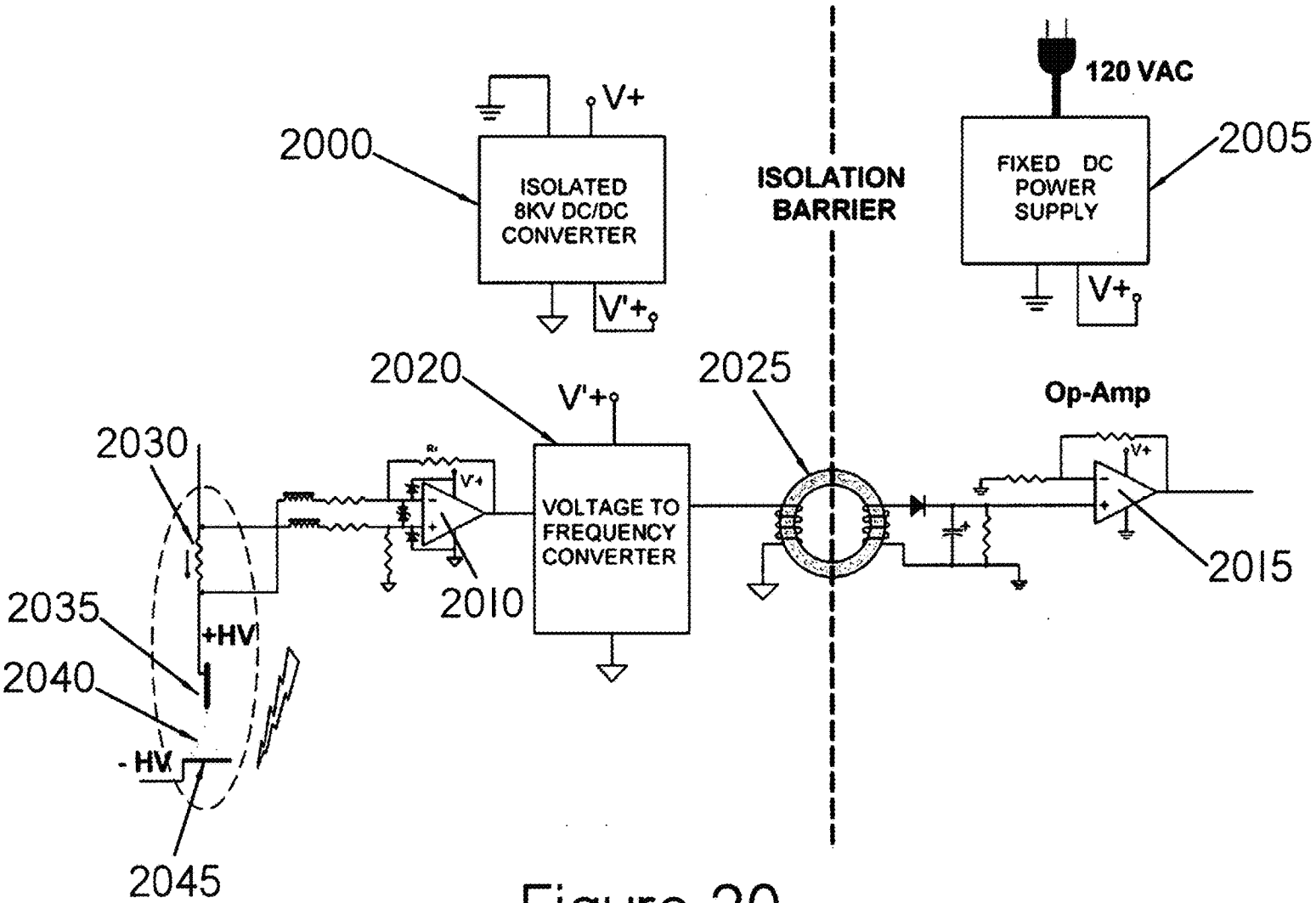
FIG. 20 is a photo of the wick-paper affixed to a polymer card support and inserted into a carrier for electrospray operation. Fluid feed and high voltage attachments are visible.
Figure 21:
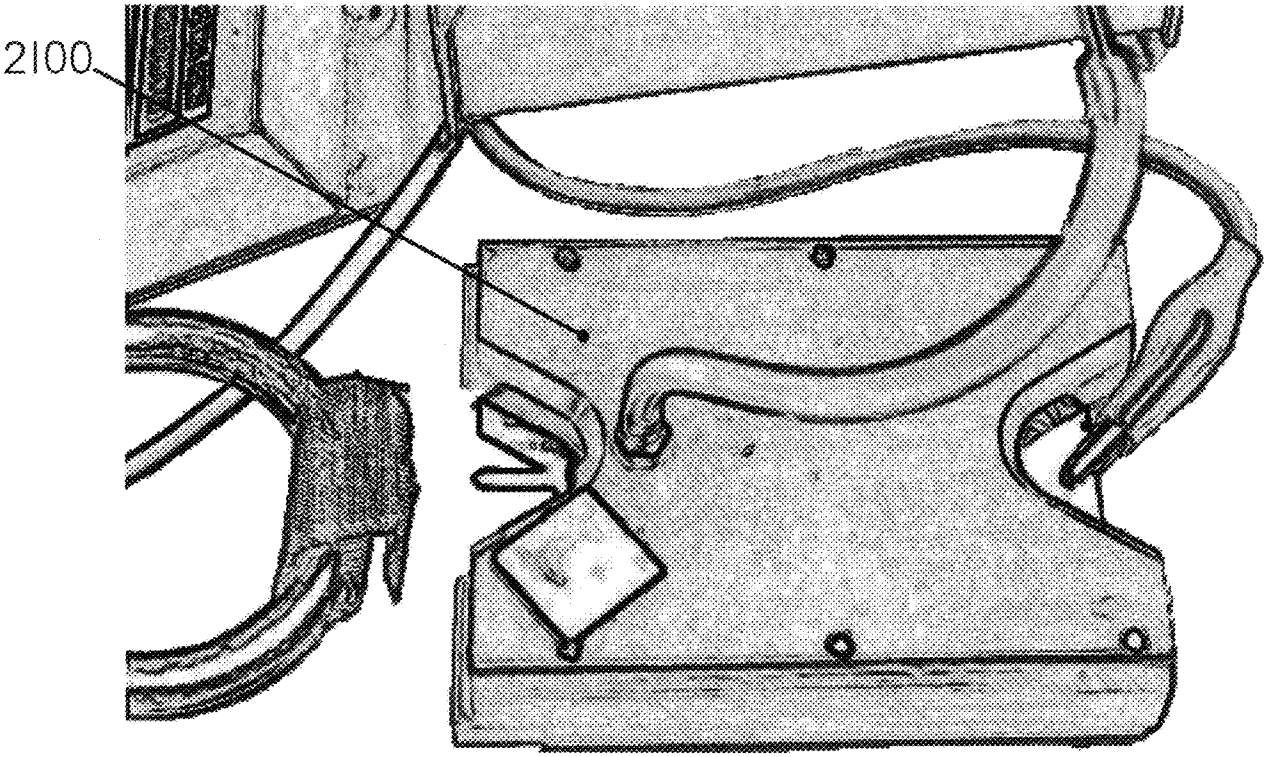
FIG. 21 is a close up photo of the dried blood that has been resolubilized from the paper spray substrate which migrates to the spray tip apex due to the applied high electric potential applied.
Figure 22:
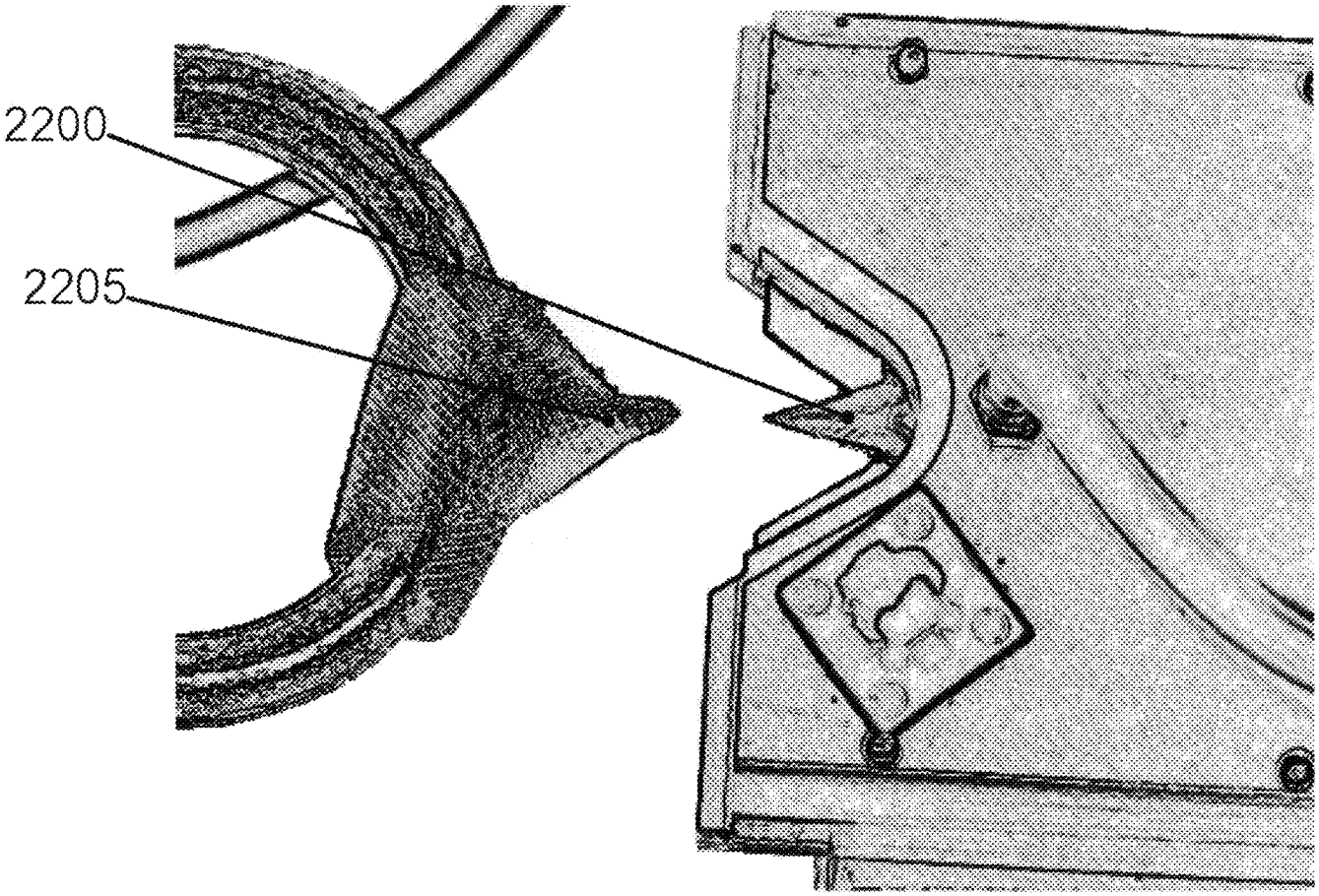
FIG. 22 shows a diagram of a polymer support on the underside of a paper spray source which precludes accumulation of fluid below the paper, protects the paper tip or apex, and which allows for paper support from the underside of the paper without risking the possible wetting of a given support structure and diversion of spray fluid which could otherwise starve the electrospray process. In this photo the polymer support is clear and appears on the top of the photo as the spray combination is turned upside-down. The metal screen and paper is preferably on top or upright in relation to gravity and the polymer support is preferably below the paper. The polymer support is preferably cut to the exact outline of the paper spray substrate.
Figure 23:
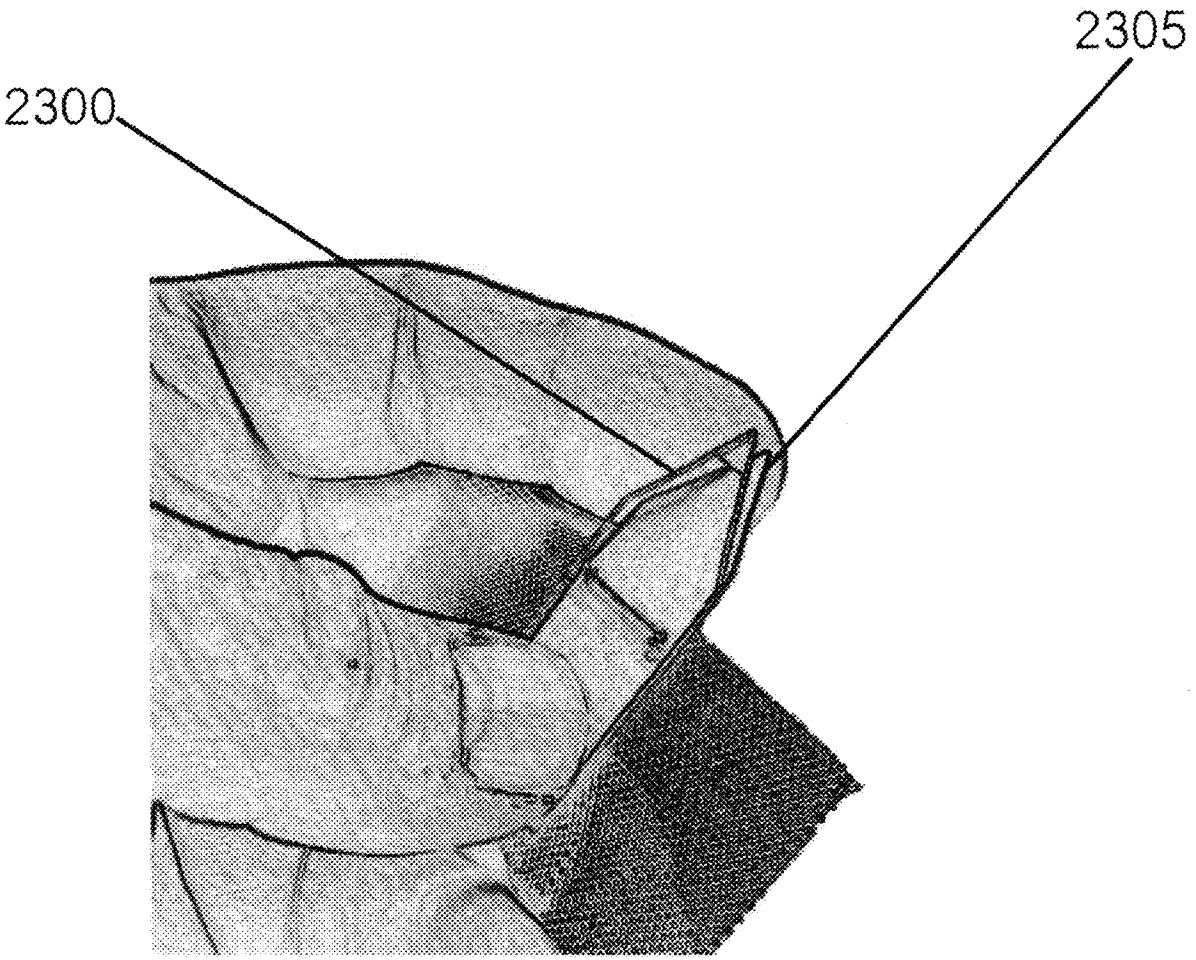
FIG. 23 is a photo of the top of the wettable paper substrate affixed by a preferably stainless steel staple to a preferably stainless wire mesh support. The wire mesh pore size is large in contrast to the wettable paper substrate media such that a capillarity gradient is created so that a preferably aqueous based fluid deposited onto the wire mesh-paper substrate combination flows from the mesh to the paper. Excess fluid is restrained in the mesh region, especially when a non-wetting preferably polymer support is affixed below the wettable paper substrate media.
Figure 24:
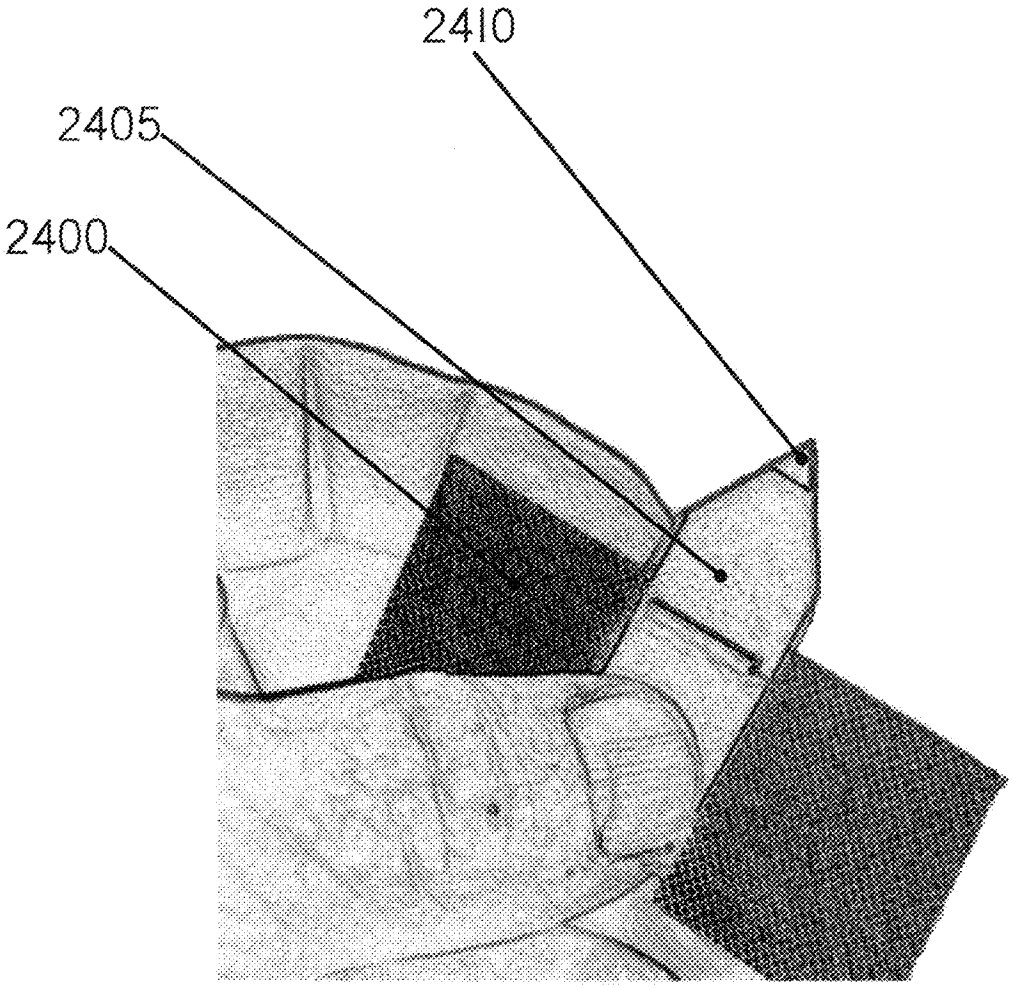
FIG. 24 shows a capillary affixed to a paper spray source in lieu of a paper apex as the source for the electrospray. The hydrophilic capillary tip wicks up fluid stored under the large pore metal wick region sandwiched with the paper substrate. The electric field is concentrated at the capillary tip and creates a spray similar to what is known as a "nanospray" according to those skilled in the art of electrospray mass spectrometry. The use of the capillary obviates the requirement for a sharp apex to be created on the paper necessary to produce an electric field concentration point leading to a Taylor Cone and thus electrospray. A glass capillary is shown in the left image and a polymer capillary in the right portion of the image. Both capillaries are preferably affixed under the wire mesh and atop the paper substrate which contains the dried analyte.
Figure 25:
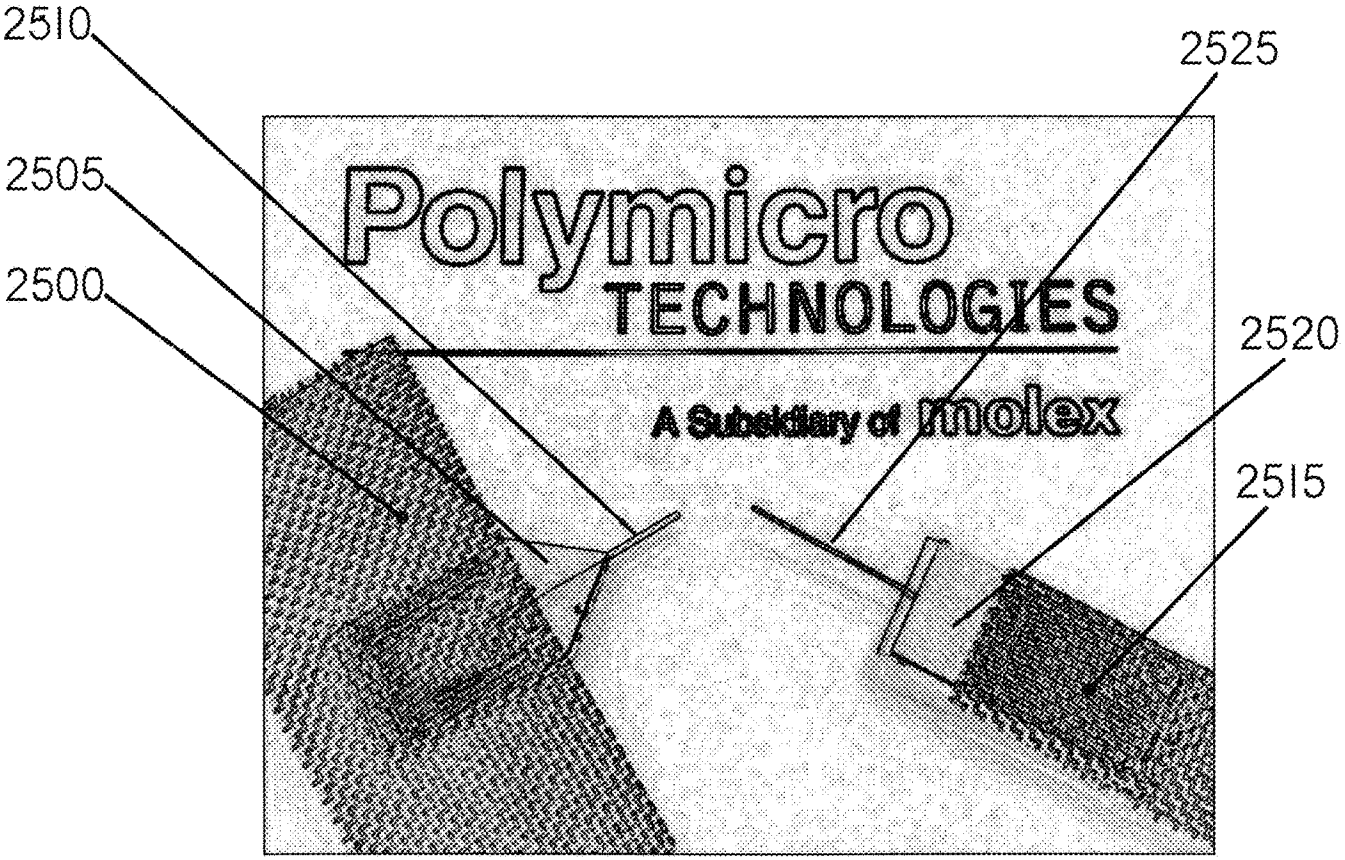
FIG. 25 is an SEM of a solid electrospray emitter used in lieu of the capillary tube described in FIG. 24. In this case, acid etched stria on the surface of a solid needle emitter preferably made from tungsten, create the wicking surfaces required to draw fluid along the needle surface to the tip where an electrospray or field desorption can transpire.
Figure 26:
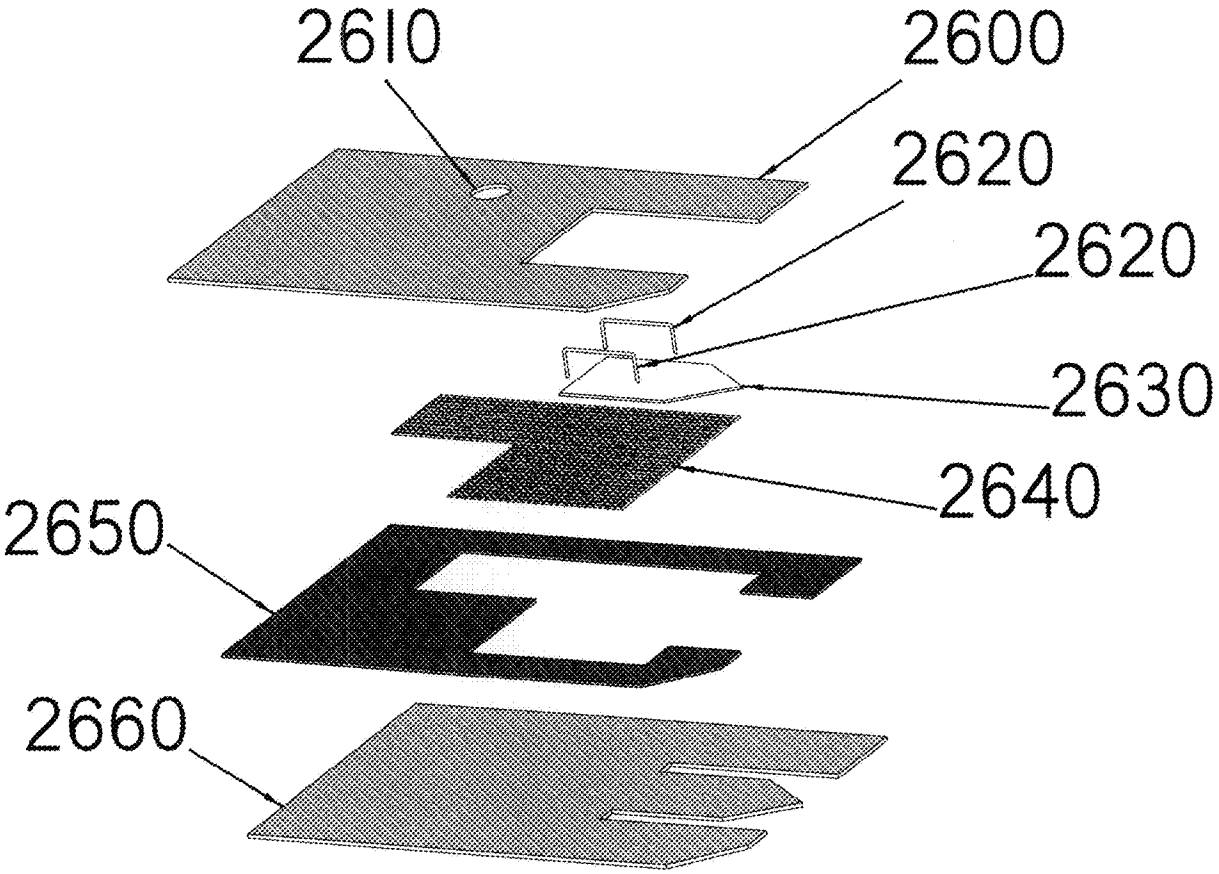
FIG. 26 is line drawing of an exploded view of the credit card-like wick assembly.
Figure 27:
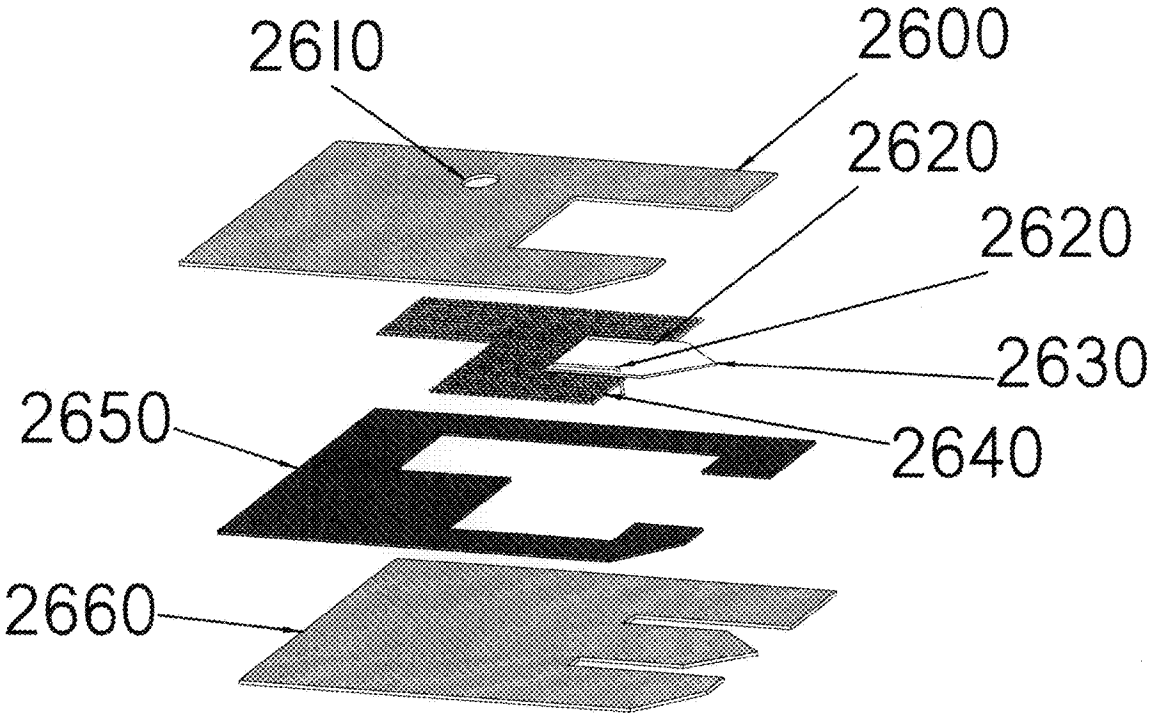
FIG. 27 is a line drawing that illustrates the porous cellulose wick assembly shown affixed to the conductive wire mesh.
Figure 28:
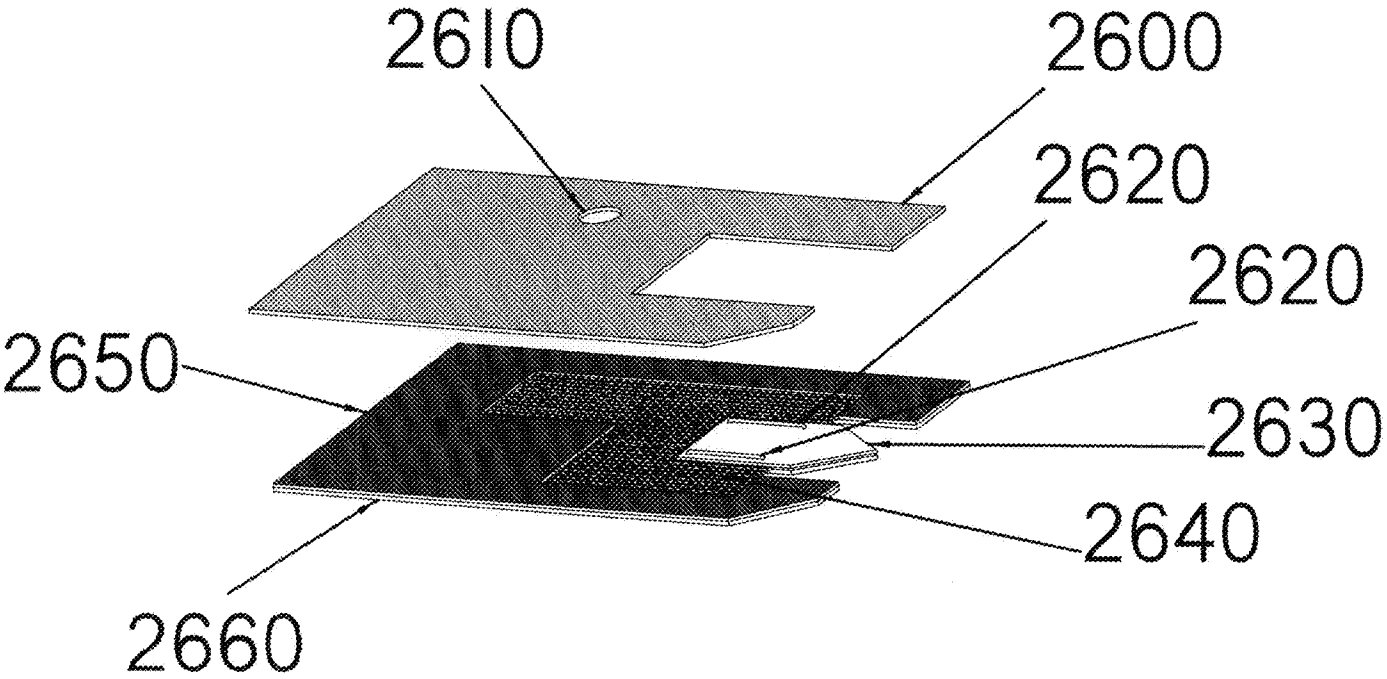
FIG. 28 is line drawing of the spray wick assembly showing the wick affixed to the wire mesh preferably with a staple or staples, illustrated being attached to the lower hydrophobic lower support, showing the hydrophobic middle spacer in place.
Figure 29:
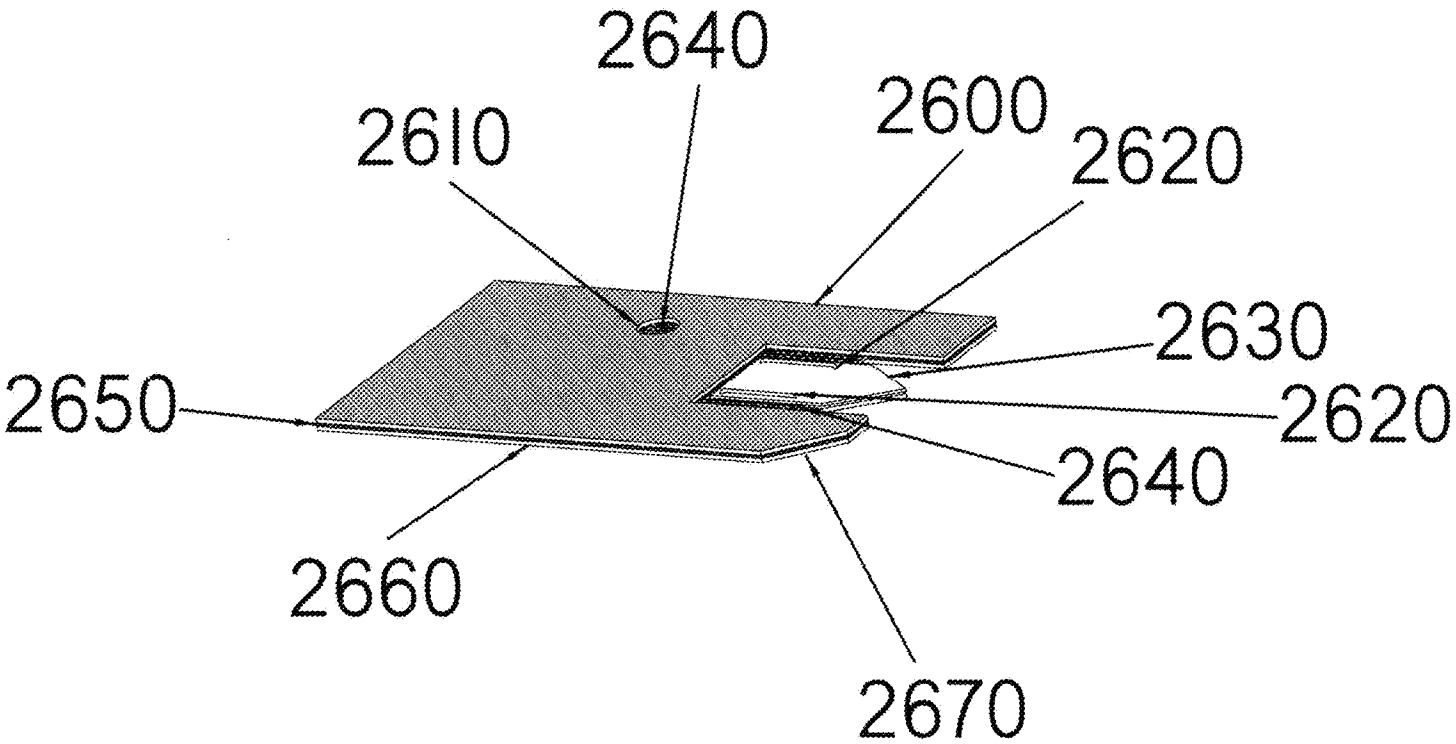
FIG. 29 is a line drawing of a completed credit card-like spray wick assembly with upper and lower hydrophobic supports, shown affixed to the paper spray and wire mesh assembly.

Where shown in FIGS. 26, 27, 28, and 29, reference number 2600 identifies the upper hydrophobic support, reference number 2660 identifies the lower hydrophobic support, reference numeral 2640 depicts the conductive wire mesh, reference number 2650 identifies the hydrophobic spacer, reference number 2620 represents a staple, reference number 2630 identifies a paper spray substrate, and reference number 2610 shows the fluid feed hole.

DEFINITIONS OF TERMS EMPLOYED

Electrospray: The name electrospray is used for an apparatus that employs electricity to disperse a liquid or for the fine aerosol resulting from this process. The method is sometimes improperly called electrohydrodynamic atomization. High voltage is applied to a liquid supplied through an emitter (sometimes a glass or metallic capillary, but for the purposes of the disclosed invention, the source of the electrospray will be from a wicking substrate media, such as paper). Ideally, when the applied field exceeds the surface tension of the solvent liquid and overcomes the Rayleigh Limit, the liquid reaching the emitter tip forms a Taylor cone, which emits a liquid jet through its apex. Varicose waves on the surface of the jet lead to the formation of small and highly charged liquid droplets, which are radially dispersed due to Coulomb repulsion.

Taylor Cone: A Taylor cone refers to the cone observed in electrospinning, electrospraying and hydrodynamic spray processes from which a jet of charged particles emanates above a threshold voltage. The solvent evaporates from a charged droplet until it becomes unstable upon reaching its Rayleigh limit. At this point, the droplet deforms as the electrostatic repulsion of like charges, in an ever-decreasing droplet size, becomes more powerful than the surface tension holding the droplet together. At this point the droplet undergoes Coulomb fission, whereby the original droplet 'explodes' creating many smaller, more stable droplets. The new droplets undergo desolvation and subsequently further Coulomb fissions.

Analyte: Target chemical or biological species to be detected qualitatively; or quantitatively, or both.

DBS: Dried Blood Spot or Dried Biological Sample

Substrate: Material that has the ability to wick an aqueous fluid, such material being paper, polymer, glass, carbon fiber, or any material machined or combination thereof, etched or altered to permit capillary action of an aqueous solution. For the purposes of this invention, a substrate does not necessarily have to be porous, although it can be porous. Surface treatment of many materials permits surface wicking, yet are not porous.

Media: Material that has the ability to wick an aqueous fluid, preferably water based.

Porous: Material that may or may not have wicking capability for aqueous fluids, and which contains pores or voids such that fluid or particulates can pass through.

Polymer: A plastic material

Mass Spectrometry: Method of determining the mass or the charge to mass ration or m/z of target ion or ions. Mass spectrometry is an analytical technique that produces spectra of the masses of the atoms or molecules constituting a sample of material.

Paper Spray: Term coined by Purdue University to represent using a paper electrospray source.

Paper Jet: Termed used in disclosed invention to represent a faster paper electrospray analysis method in contrast to the Purdue University embodiment Cohesive: the attractive force of similar molecules to one another. For the purposes of the disclosed invention, the attractive forces of aqueous fluid molecules to one another Adhesive: the attractive force of similar molecules to dissimilar materials. For the purposes of the disclosed invention, the attractive forces of aqueous fluid molecules to another material.

Capillary Action: The movement of a liquid along the surface of a solid caused by the attraction of molecules of the liquid to the molecules of the solid.

The paper towel industry owes its existence to capillary action, both for the way paper towels soak up liquids and for the trees out of which the towels are made. Molecules of water are naturally attracted to each other and form temporary hydrogen bonds with each other; their attraction for each other on the surface of a liquid, for example, gives rise to surface tension. But they are also attracted in a similar way to other molecules, called hydrophilic molecules, such as those in the sides of a narrow glass tube inserted into a cup of water, in the fibers of a towel, or in the cells of tree tissue known as xylem. These attractive forces can draw water upward against the force of gravity to a certain degree. However, they are not strong enough to draw water from the roots of a tree to its highest leaves. An additional, related force, referred to as transpiration pull, is required to do that. As water evaporates from the tiny pores, or stomata, of leaves, water from adjacent cells is drawn in to replace it by osmosis. Again, intermolecular attractive forces cause other water molecules to follow along, ultimately drawing water up from the roots of the tree.

Capillarity: The ability of a material to demonstrate capillary action.

Capillarity Gradient: The change in the structure of a material capable of capillary forces along the wick capable region of that material. For the purposes of the disclosed invention, a change in paper pore size along the length of the paper will cause a wetting solvent to move preferentially in the direction of increased pore or void or stria on or within the paper media or substrate.

Wicking: The ability of a material to attract and soak up or draw in a liquid due to capillary forces.

Surface Tension: The tension of the surface film of a liquid caused by the attraction of the particles in the surface layer by the bulk of the liquid, which tends to minimize surface area. The force that causes the molecules on the surface of a liquid to be pushed together and form a layer Contact Angle: The angle between a fluid and a dissimilar surface.

Surfactant: A material which reduces the surface tension of a fluid.

Solvent: A Substance, ordinarily a liquid, in which other materials dissolve to form a solution. Polar solvents (e.g., water) favor formation of ions; non-polar ones (e.g., hydrocarbons) do not. Solvents may be predominantly acidic, predominantly basic, amphoteric (both), or aprotic (neither). Organic compounds used as solvents include aromatic compounds and other hydrocarbons, alcohols, esters, ethers, ketones, amines, and nitrated and halogenated hydrocarbons. Their chief uses are as media for chemical syntheses, as industrial cleaners, in extractive processes, in pharmaceuticals, in inks, and in paints, varnishes, and lacquers. In the preferred embodiment of the present patent application, the solvent is water.

Detergent: Detergents are a class of molecules whose unique properties enable manipulation (disruption or formation) of hydrophobic-hydrophilic interactions among molecules in biological samples. In biological research, detergents are used to lyse cells (release soluble proteins), solubilize membrane proteins and lipids, control protein crystallization, prevent nonspecific binding in affinity purification and immunoassay procedures, and as additives in electrophoresis. Detergents are amphipathic molecules, meaning they contain both a nonpolar "tail" having aliphatic or aromatic character and a polar "head". Ionic character of the polar head group forms the basis for broad classification of detergents; they may be ionic (charged, either anionic or cationic), nonionic (uncharged) or zwitterionic (having both positively and negatively charged groups but with a net charge of zero). For the purposes of the disclosed invention, a detergent is used to lyse biological samples such as cells and to reduce the surface tension of the spray fluid so that wetting capability on a given substrate is enhanced.

Raman Spectroscopy: is a spectroscopic technique used to observe vibrational, rotational, and other low-frequency modes in a system. It relies on inelastic scattering, or Raman scattering, of monochromatic light, usually from a laser in the visible, near infrared, or near ultraviolet range.

Surface Enhanced Raman Spectroscopy: Surface-enhanced Raman spectroscopy or surface-enhanced Raman scattering (SERS) is a surface-sensitive technique that enhances Raman scattering by molecules adsorbed on rough metal surfaces or by nanostructures such as plasmonic-magnetic silica nanotubes. The enhancement factor can be as much as $10^{10}$ to $10^{11}$, which means the technique may detect single molecules.

We claim:

1. A polymer credit-card-like wick support system comprising:

a polymer credit-card-like wick support, a paper or paper-like substrate, on which a sample of an analyte has been deposited to form a dried sample, the paper substrate having a first end cut to form a sharp tip, with a second end cut square, and a space between the sharp tip and the square end where the sample of the analyte is deposited, a conductive wire mesh affixed to the paper or paper-like substrate and to the polymer credit-card-like wick support, such that when a spray of wetting fluid is applied to the dried sample, a capillarity gradient flows from the wire mesh to the paper or paper-like substrate, the conductive wire mesh having a single electrical terminal coupled to a first terminal of an adjustable high voltage source, a second terminal of the high voltage source being coupled to a measuring instrument conductive input, the sharp point being positioned near the measuring instrument conductive input and the high voltage source being increased to form a Taylor cone that extends from the measuring input of the high voltage source to the sharp tip of the paper or paper-like substrate.

2. The polymer credit-card-like wick support system of claim 1 wherein the conductive wire mesh is a plated polymer.

3. The polymer credit-card-like wick support system of claim 1 further comprising:

a circular opening in the conductive wire mesh located directly over a section of the paper or paper-like substrate to permit the application of analyte to the substrate.

4. The polymer credit-card-like wick support system of claim 1 wherein measuring instrument with a conductive input further comprises:

a fixture with a slot for holding the polymer credit-card-like wick support, with the paper or paper-like substrate and the conductive wire mesh being coupled to the polymer credit-card-like wick support, and a fluid feed orifice positioned directly over the polymer credit-card-like wick support system.

5. A polymer credit-card-like wick support comprising:

a polymer wick support card having an aperture extending to an edge of the polymer wick support card, a paper substrate on which a sample of an analyte has been deposited to form a dried sample, the paper substrate having a first end cut to form a sharp tip, with a second end cut square, and a space between the sharp tip and the square end where the sample of the analyte is deposited, a conductive mesh to form a support for the paper substrate, the conductive mesh being coupled to the polymer wick support card and positioned to hold and support the paper substrate with the dried sample sandwiched between the conductive mesh and aperture and with the sharp tip of the substrate extending in the aperture to the edge of the polymer wick support card.

6. The polymer credit-card-like wick support of claim 5 further comprising:

a CCD image capture of the blood area seen above and below the substrate media that permits a computerized optical integration of blood volume.

7. The polymer credit-card-like wick support of claim 6 further comprising:

a bar code to provide data selected from fields of date including a patient, a card lot, a date.

8. The polymer credit-card-like wick support of claim 7 further comprising:

an a RFID chip to be in the polymer wick support card, or in a plastic DBS Card sleeve containing the polymer wick support card, whereby; the data can sampled optically or wirelessly.

* * * * *